US011215178B2

(12) United States Patent
Watanabe et al.

(10) Patent No.: US 11,215,178 B2
(45) Date of Patent: Jan. 4, 2022

(54) VARIABLE CAPACITY PUMP AND WORKING OIL SUPPLY SYSTEM FOR INTERNAL COMBUSTION ENGINE

(71) Applicant: HITACHI AUTOMOTIVE SYSTEMS, LTD., Hitachinaka (JP)

(72) Inventors: Yasushi Watanabe, Kanagawa (JP); Atsushi Naganuma, Atsugi (JP); Koji Saga, Ebina (JP); Hideaki Ohnishi, Atsugi (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 235 days.

(21) Appl. No.: 16/333,204

(22) PCT Filed: Aug. 4, 2017

(86) PCT No.: PCT/JP2017/028370
§ 371 (c)(1),
(2) Date: Mar. 13, 2019

(87) PCT Pub. No.: WO2018/051674
PCT Pub. Date: Mar. 22, 2018

(65) Prior Publication Data

US 2019/0226479 A1 Jul. 25, 2019

(30) Foreign Application Priority Data

Sep. 16, 2016 (JP) ..... JP2016-181740

(51) Int. Cl.
*F04C 14/22* (2006.01)
*F04C 2/344* (2006.01)
*F04B 49/22* (2006.01)

(52) U.S. Cl.
CPC ..... *F04C 14/226* (2013.01); *F04C 2/344* (2013.01); *F04C 14/223* (2013.01); *F04B 49/22* (2013.01); *F04C 2210/206* (2013.01)

(58) Field of Classification Search
CPC ..... F04B 49/22
See application file for complete search history.

(56) References Cited

U.S. PATENT DOCUMENTS 5,085,051 A 2/1992 Hirata
2010/0226799 A1 9/2010 Watanabe et al.
(Continued)

FOREIGN PATENT DOCUMENTS

JP H02-076904 A 3/1990
JP 2010-209718 A 9/2010
(Continued)

*Primary Examiner* — Charles G Freay
(74) *Attorney, Agent, or Firm* — Foley & Lardner LLP

(57) ABSTRACT

Provided is a variable capacity pump where ease of control can be improved. A variable capacity pump includes a control chamber and a control mechanism. The control chamber is disposed between a pump accommodating chamber and a movable member, and the volume of the control chamber is variable with the movement of the movable member. Working oil discharged from a discharge portion is introduced into the control chamber. The control mechanism includes a spool, a biasing member, and a solenoid. The spool is provided in a passage, and is configured to control introduction of working oil into the control chamber by moving in a cylindrical portion. The spool is biased to one side in an axial direction by a pressure of working oil introduced into the cylindrical portion from the discharge portion. The biasing member biases the spool to an opposite side in the axial direction. The solenoid is configured to generate an electromagnetic force for biasing the spool in the axial direction, and to change a magnitude of the
(Continued)

electromagnetic force according to a value of an electric current supplied.

11 Claims, 19 Drawing Sheets

(56) References Cited

U.S. PATENT DOCUMENTS

| | | | | |
|---|---|---|---|---|
| 2014/0072456 | A1* | 3/2014 | Watanabe | F04B 49/002 417/218 |
| 2014/0261716 | A1* | 9/2014 | Van Weelden | F04C 14/18 137/12 |
| 2015/0010759 | A1* | 1/2015 | Iwamura | C09D 5/32 428/413 |
| 2015/0110659 | A1* | 4/2015 | Saga | F04C 2/3442 418/26 |
| 2015/0252803 | A1* | 9/2015 | Ohnishi | F04C 2/344 418/26 |
| 2016/0177949 | A1* | 6/2016 | Kido | F04C 14/226 418/22 |
| 2016/0290335 | A1 | 10/2016 | Cuneo et al. | |
| 2019/0017596 | A1* | 1/2019 | Senbongi | F16H 61/0021 |

FOREIGN PATENT DOCUMENTS

| | | | |
|---|---|---|---|
| JP | 2014-066178 | A | 4/2014 |
| JP | 2014-178028 | A | 9/2014 |
| JP | 2016-118112 | A | 6/2016 |
| WO | WO-2012/149929 | A2 | 11/2012 |
| WO | WO-2015/074700 | A1 | 5/2015 |
| WO | WO 2018/235627 | A1 * | 12/2018 |

* cited by examiner

VARIABLE CAPACITY PUMP AND WORKING OIL SUPPLY SYSTEM FOR INTERNAL COMBUSTION ENGINE

TECHNICAL FIELD

The present invention relates to a variable capacity pump.

BACKGROUND ART

Conventionally, variable capacity pumps are known.

CITATION LIST

Patent Literature

PTL 1: Japanese Patent Laid-Open No. 2010-209718

SUMMARY OF INVENTION

Technical Problem

Conventional variable capacity pumps have room for improvement in terms of ease of control.

Solution to Problem

A variable capacity pump according to one embodiment of the present invention preferably includes a spool which is capable of controlling introduction of working oil into a control chamber, and a solenoid which is capable of changing the magnitude of an electromagnetic force which biases the spool.

Accordingly, ease of control can be improved.

DESCRIPTION OF EMBODIMENTS

Hereinafter, embodiments of the present invention are described with reference to drawings.

First Embodiment

Figure 1:
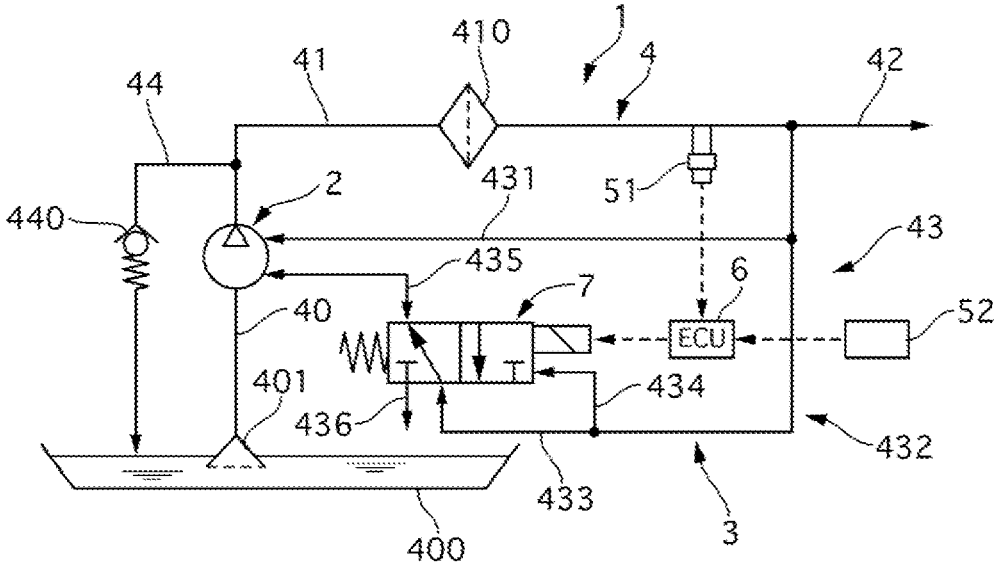
FIG. 1 is a circuit diagram of a working oil supply system for an engine of a first embodiment.

First, the configuration is described. A variable capacity pump (hereinafter referred to as "pump") 2 of this embodiment is an oil pump used in a working oil supply system 1 of an internal combustion engine (engine) of an automobile. The pump 2 is disposed at a front end portion or the like of a cylinder block of the engine. The pump 2 supplies oil (working oil), which is a fluid having functions, such as lubrication, to respective slide portions of the engine, and to a variable valve device (valve timing control device and the like) which variably controls operation characteristics of a valve of the engine. As shown in FIG. 1, the working oil supply system 1 of the engine includes an oil pan 400, a passage 4, the pump 2, a pressure sensor (pressure measuring portion) 51, a rotational speed sensor (rotational speed measuring portion) 52, and an engine control unit (control portion) 6. The oil pan 400 is a low pressure portion which is disposed below the engine, and where working oil is stored. The passage 4 is disposed in the cylinder block, for example, and has an intake passage 40, a discharge passage 41, a main gallery 42, a control passage 43, and a relief passage 44. One end of the intake passage 40 is connected to the oil pan 400 by way of an oil filter 401. The other end of the intake passage 40 is connected to the pump 2. One end of the discharge passage 41 is connected to the pump 2. The other end of the discharge passage 41 is connected to the main gallery 42. An oil filter 410 and the pressure sensor 51 are provided in the discharge passage 41. The main gallery 42 is connected to the respective slide portions of the engine, the variable valve device and the like. The relief passage 44 is branched from the discharge passage 41, and is connected to the oil pan 400. A relief valve 440 is provided in the relief passage 44.

Figure 2:
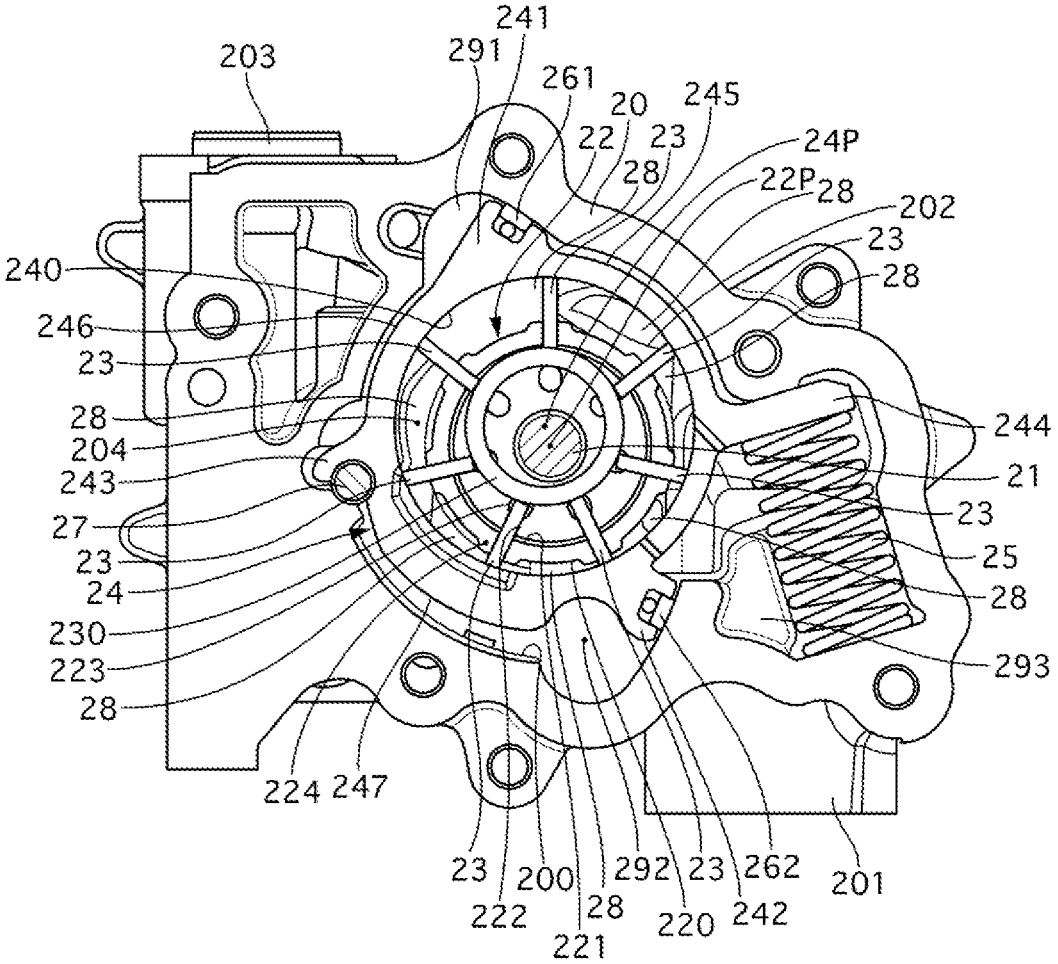
FIG. 2 is a front view showing a portion of a pump of the first embodiment.

As shown in FIG. 2, the pump 2 is a vane pump. The pump 2 includes a housing, a shaft (drive shaft) 21, a rotor 22, a plurality of vanes 23, a cam ring 24, a spring (first biasing member) 25, a first sealing member 261, a second sealing member 262, a pin 27, and a control mechanism 3. The housing includes a housing body 20 and a cover. FIG. 2 shows the pump 2 from which the cover is removed. The housing body 20 has, on the inside thereof, a pump accommodating chamber 200, an intake opening (intake portion) 201, and a discharge opening (discharge portion) 203. The pump accommodating chamber 200 has a bottomed cylindrical shape, and opening of the pump accommodating chamber 200 is formed in one side surface of the housing body 20. A hole (shaft accommodating hole), in which the drive shaft 21 is accommodated, and a hole (pin hole), in which the pin 27 is fixed, are formed in a bottom surface of the pump accommodating chamber 200. The cover is mounted on the one side surface of the housing body 20 by a plurality of bolts, thus closing the opening of the pump accommodating chamber 200. One end of the intake opening 201 is open on the outer surface of the housing body 20, and the other end of the intake passage 40 is connected to the one end of the intake opening 201. The other end of the intake opening 201 is open on the bottom surface of the pump accommodating chamber 200 as an intake port 202. The intake port 202 is a groove (recessed portion) extending in a circumferential direction of the shaft accommodating hole, and is disposed on a side opposite to the pin hole with respect to the shaft accommodating hole. One end of the discharge opening 203 is formed in the bottom surface of the pump accommodating chamber 200 as a discharge port 204. The discharge port 204 is a groove (recessed portion) extending in a circumferential direction of the shaft accommodating hole, and is disposed on the pin hole side of the shaft accommodating hole. The other end of the discharge opening 203 is open on the outer surface of the housing body 20, and one end of the discharge passage 41 is connected to the other end of the discharge opening 203. Grooves which correspond to the intake port 202 and the discharge port 204 of the housing body 20 are also formed on a surface of the cover which closes the pump accommodating chamber 200. The rotor 22, the plurality of vanes 23, the cam ring 24, and the spring 25 are disposed in the pump accommodating chamber 200.

The drive shaft 21 is rotatably supported on the housing. The drive shaft 21 is coupled to a crankshaft by way of a chain, a gear or the like. The rotor 22 is fixed to the drive shaft 21 in the circumferential direction. The rotor 22 has a columnar shape. A surface of the rotor 22 on one side in the axial direction has a recessed portion 221. A plurality of (seven) slits 222 extending in the radial direction are formed in the rotor 22. Back pressure chambers 223 are disposed on the inner side of the slits 222 in the radial direction. The outer peripheral surface 220 of the rotor 22 has projecting portions 224 which protrude outward in the radial direction. The slits 222 are open on the projecting portions 224. The vanes 23 are accommodated in the slits 222. An annular member 230 is provided in the recessed portion 221. The outer peripheral surface of the member 230 opposes the proximal ends of the respective vanes 23. An inner peripheral surface 240 of the cam ring 24 has a cylindrical shape. The outer periphery of the cam ring 24 has four protrusions 241 to 244 which protrude outward in the radial direction. The first sealing member 261 is mounted on the first protrusion 241. The second sealing member 262 is mounted on the second protrusion 242. The pin 27 is fitted in the third protrusion 243. As viewed in the axial direction of the cam ring 24, the first protrusion 241 and the second protrusion 242 are disposed on sides opposite to each other with respect to a straight line passing through the axis of the pin 27 and a center 24P of the inner peripheral surface 240 of the cam ring. One end of the spring 25 is mounted on the fourth protrusion 244.

On the inside of the pump accommodating chamber 200, a first control chamber 291, a first control chamber 292, and a spring accommodating chamber 293 are present between the housing and the cam ring 24. The first control chamber 291 is formed of a space defined between a portion of an outer peripheral surface 245 of the cam ring 24 ranging from the first protrusion 241 (first sealing member 261) to the third protrusion 243 (pin 27) and the inner peripheral surface of the housing (pump accommodating chamber 200). The first control chamber 291 is sealed by the first sealing member 261 and the pin 27. A first region 246 defined between the first sealing member 261 and the pin 27 on the outer peripheral surface 245 of the cam ring faces the first control chamber 291. A second control chamber 292 is formed of a space defined between a portion of the outer peripheral surface 245 of the cam ring ranging from the second protrusion 242 (second sealing member 262) to the third protrusion 243 (pin 27) and the inner peripheral surface of the housing (pump accommodating chamber 200). The second control chamber 292 is sealed by the second sealing member 262 and the pin 27. A second region 247 defined between the second sealing member 262 and the pin 27 on the outer peripheral surface 245 of the cam ring faces the second control chamber 292. The area of the second region 247 (angle subtended by the second region 247 in the circumferential direction of the cam ring 24) is slightly larger than the area of the first region 246 (angle subtended by the first region 246 in the circumferential direction of the cam ring 24). The width in the radial direction of a portion of the cam ring 24 which corresponds to the second region 247 (the end surface in the axial direction of the cam ring 24, the end surface being formed so as to continue to the second region 247, and opposing the bottom surface of the pump accommodating chamber 200) is larger than the width in the radial direction of a portion of the cam ring 24 which corresponds to the first region 246 (the end surface in the axial direction of the cam ring 24, the end surface being formed so as to continue to the first region 246, and opposing the bottom surface of the pump accommodating chamber 200) in average at least in a region which is disposed adjacent to the discharge port 204 in the radial direction. The spring accommodating chamber 293 is formed of a space defined between a portion of the outer peripheral surface 245 of the cam ring ranging from the first protrusion 241 (first sealing member 261) to the second protrusion 242 (second sealing member 262) via the fourth protrusion 244, and the inner peripheral surface of the housing (pump accommodating chamber 200).

The spring 25 is a compression coil spring. One end of the spring 25 is brought into contact with the surface of the fourth protrusion 244 on one side in the circumferential direction of the cam ring 24. The surface of the fourth protrusion 244 on the other side in the circumferential direction of the cam ring 24 opposes the inner peripheral surface of the pump accommodating chamber 200 (spring accommodating chamber 293), and is capable of coming into contact with this inner peripheral surface. The other end of the spring 25 is mounted on the inner peripheral surface of the pump accommodating chamber 200 (spring accommodating chamber 293). The spring 25 is in a compressed state. The spring 25 has a predetermined set load in an initial state, and always biases the fourth protrusion 244 to the other side in the circumferential direction.

The control mechanism 3 includes the control passage 43 and a control valve 7. As shown in FIG. 1, the control passage 43 includes a first feedback passage 431 and a second feedback passage 432. One end side of the first feedback passage 431 is branched from the discharge passage 41. The other end of the first feedback passage 431 is connected to the first control chamber 291. The second feedback passage 432 includes a supply passage 433, a control passage 434, a communication passage 435, and a drainage passage 436. One end side of the supply passage 433 is branched from the first feedback passage 431. The other end of the supply passage 433 is connected to the control valve 7. One end side of the control passage 434 is branched from the supply passage 433. The other end of the control passage 434 is connected to the control valve 7. One end of the communication passage 435 is connected to the control valve 7. The other end of the communication passage 435 is connected to the second control chamber 292. One end of the drainage passage 436 is connected to the control valve 7. The other end of the drainage passage 436 is connected to the oil pan 400.

Figure 3:
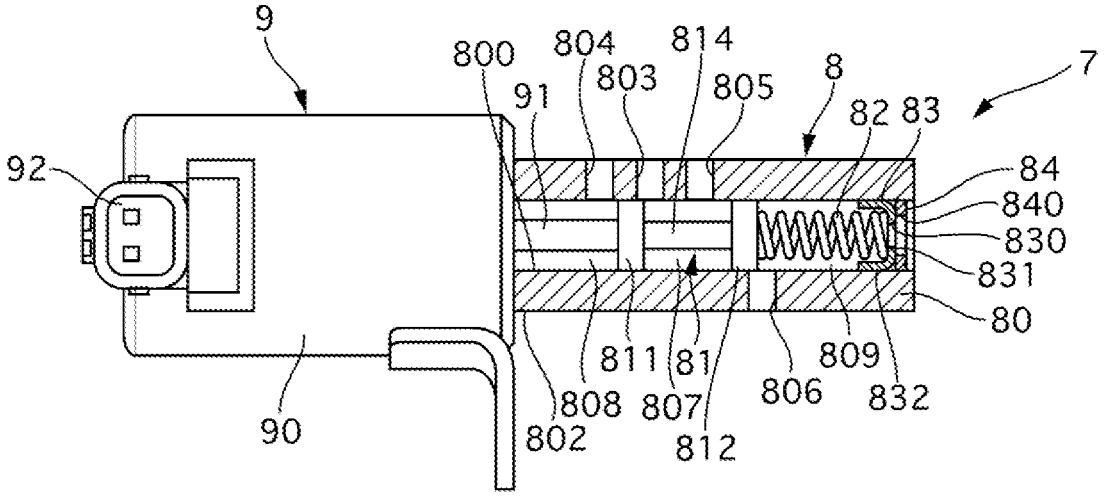
FIG. 3 is a schematic view of a control valve in the first embodiment.

As shown in FIG. 3, the control valve 7 is formed of an electromagnetic valve (solenoid valve), and includes a valve portion 8 and a solenoid portion 9. The valve portion 8 includes a cylinder (cylindrical portion) 80, a spool 81, a spring (second biasing member) 82, a retainer 83, and a stopper 84. In FIG. 3, only the cylinder 80 is shown in cross section. The solenoid portion 9 includes a casing 90, a solenoid, a plunger, a rod 91, and a connector 92. An inner peripheral surface 800 of the cylinder 80 has a cylindrical shape, and both ends of the cylinder 80 in the axial direction are open. The cylinder 80 has a plurality of ports. These ports are holes which penetrate the cylinder 80 in the radial direction, and each of these ports are open on the inner peripheral surface 800 and an outer peripheral surface 802 of the cylinder 80. These ports function as portions of the second feedback passage 432 together with the spaces on the inner peripheral side of the cylinder 80. The plurality of ports includes a supply port 803, a control port 804, a communication port 805, and a drainage port 806. The drainage port 806, the communication port 805, the supply port 803, and the control port 804 are arranged in this order from one side to the other side in the axial direction of the cylinder 80. The other end of the control passage 434 is connected to the control port 804. The control port 804 communicates with the discharge opening 203 through the control passage 434 (second feedback passage 432) and the discharge passage 41. The control port 804 allows working oil discharged through the discharge opening 203 to be introduced into the cylinder 80. The other end of the supply passage 433 is connected to the supply port 803. The supply port 803 communicates with the discharge opening 203 through the supply passage 433 (second feedback passage 432) and the discharge passage 41. The supply port 803 allows working oil discharged through the discharge opening 203 to be introduced into the cylinder 80. One end of the communication passage 435 is connected to the communication port 805. The communication port 805 communicates with the second control chamber 292 through the communication passage 435. The communication port 805 allows the inside of the cylinder 80 and the second control chamber 292 to communicate with each other. One end of the drainage passage 436 is connected to the drainage port 806. The drainage port 806 communicates with the oil pan 400 through the drainage passage 436. The drainage port 806 can drain working oil from the inside of the cylinder 80.

The spool 81 is a valve element (valve) on the second feedback passage 432. The spool 81 is disposed in the cylinder 80, and is reciprocable in the axial direction of the cylinder 80 along the inner peripheral surface 800 of the cylinder. The spool 81 includes a first land portion 811, a second land portion 812, and a thin shaft portion 814. The second land portion 812 is disposed at the end of the spool 81 on one side in the axial direction. The first land portion 811 is disposed at the end of the spool 81 on the other side in the axial direction. The thin shaft portion 814 is disposed between the first land portion 811 and the second land portion 812, and connects both land portions 811, 812 with each other. The diameter of the first land portion 811 and the diameter of the second land portion 812 are equal to each other. The diameter of both land portions 811, 812 is slightly smaller than the diameter of the inner peripheral surface 800 of the cylinder. The diameter of the thin shaft portion 814 is smaller than the diameter of both land portions 811, 812. The respective land portions 811, 812 come into slide contact with the inner peripheral surface 800 of the cylinder.

The retainer 83 has a bottomed cylindrical shape, and has a hole 830 in a bottom portion 831. The retainer 83 is disposed at the end of the cylinder 80 in the axial direction. A cylindrical portion 832 of the retainer 83 is fitted in the inner periphery of the cylinder 80. The stopper 84 has an annular shape, and has a hole 840 at a center portion thereof. The stopper 84 is disposed at the end of the cylinder 80 on one side in the axial direction, and partially closes the opening of the cylinder 80. The surface of the stopper 84 on the other side in the axial direction opposes the bottom portion 831 of the retainer 83.

A space 807 is defined between the first land portion 811 and the second land portion 812 as a liquid chamber in the inside of the cylinder 80, and a space 808 is defined between the first land portion 811 and the casing 90 of the solenoid portion 9 as a liquid chamber in the inside of the cylinder 80. A space 809 is defined between the second land portion 812 and the retainer 83. The space 807 is defined by the inner peripheral surface 800 of the cylinder, the outer peripheral surface of the thin shaft portion 814, the surface of the first land portion 811 on one side in the axial direction, and the surface of the second land portion 812 on the other side in the axial direction. The space 807 has a cylindrical shape (annular shape). The supply port 803 is open to the space 807 in the initial state, and the communication port 805 is always open to the space 807. The drainage port 806 may be open to the space 807. The space 808 is defined by the inner peripheral surface 800 of the cylinder, the surface of the first land portion 811 on the other side in the axial direction, and the surface of the casing 90 on one side in the axial direction. The control port 804 is always open to the space 808. On the inner peripheral side of the cylinder 80, the space 809 is defined by the surface of the second land portion 812 on one side in the axial direction and the bottom portion 831 of the retainer 83. The drainage port 806 is open to the space 809 in the initial state. The spring 82 is formed of a compression coil spring, and is disposed in the space 809. The space 809 functions as a spring chamber which accommodates the spring 82. One end side of the spring 82 is fitted in the inner peripheral side of the retainer 83, and one end of the spring 82 is brought into contact with the bottom portion 831 of the retainer 83. The other end of the spring 82 is brought into contact with an end surface of the spool 81 (second land portion 812) on one side in the axial direction. The spring 82 is in a compressed state. The spring 82 has a predetermined set load in the initial state, and always biases the spool 81 to the other side in the axial direction.

Figure 4:
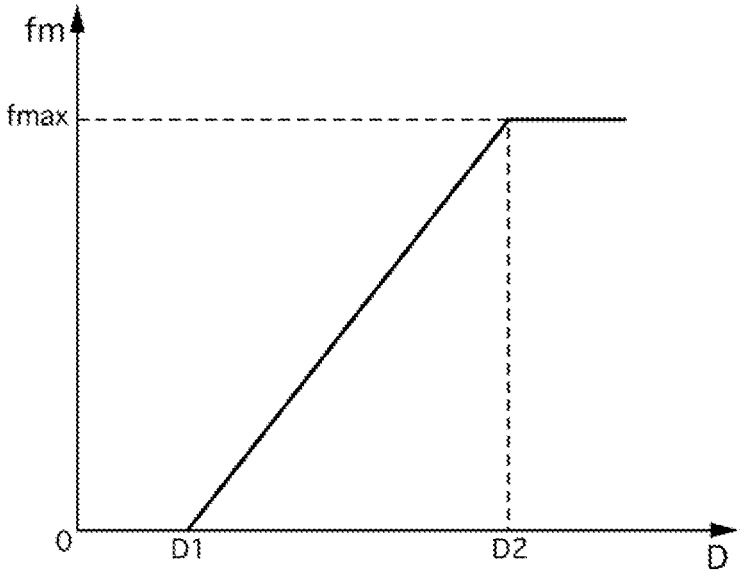
FIG. 4 is a graph showing the relationship between a duty ratio D and an electromagnetic force fm of a solenoid in the first embodiment.

The solenoid portion 9 is joined to the other side of the valve portion 8 in the axial direction, thus closing the opening of the cylinder 80 on the other side in the axial direction. The solenoid portion 9 is an electromagnet which receives a supply of an electric current through the connector 92. A solenoid and a plunger are accommodated in the casing 90. The solenoid (coil) generates an electromagnetic force when energized. The plunger (armature) is made of a magnetic material, is disposed on the inner peripheral side of the solenoid, and is movable in the axial direction. The plunger is biased in the axial direction by an electromagnetic force generated by the solenoid. The rod 91 is joined to the plunger. One end of the rod 91 protrudes into the inner peripheral side of the cylinder 80 (space 808), and the end surface of the rod 91 opposes the end surface of the spool 81 (first land portion 811) on the other side in the axial direction. The rod 91 functions as a member which allows the solenoid to bias the spool 81 in the axial direction. The rod 91 is separate (is a member separate) from the spool 81. The above-mentioned electromagnetic force biases the spool 81 to one side in the axial direction via the rod 91. This electromagnetic force (thrust of the solenoid for propelling the spool 81) is assumed as "fm". The solenoid can continuously change the magnitude of an electromagnetic force fm according to the value of an electric current supplied. The solenoid portion 9 is subjected to a PWM control, and the current value of the solenoid is given as a duty ratio D. As shown in FIG. 4, an electromagnetic force fin varies according to duty ratio D (the current value of the solenoid). When a duty ratio D is less than a predetermined value D1 (dead zone), an electromagnetic force fm assumes zero, which is the minimum value (the electromagnetic force is not generated), regardless of the magnitude of the duty ratio D. When a duty ratio D is equal to or more than the predetermined value D1 and less than a predetermined value D2, an electromagnetic force fm varies according to the duty ratio D. With a larger duty ratio D, the electromagnetic force fm increases more. When a duty ratio D is equal to or more than the predetermined value D2, an electromagnetic force fm assumes the maximum value fmax regardless of the magnitude of the duty ratio D.

The pressure sensor 51 detects (measures) the pressure of working oil discharged through the discharge opening 203 of the pump 2 to the discharge passage 41. In other words, the pressure sensor 51 detects (measures) the pressure in the main gallery 42 (main gallery hydraulic pressure P). The rotational speed sensor 52 detects (measures) the rotational speed Ne of the engine (crankshaft).

The engine control portion (hereinafter, ECU) 6 controls the opening/closing of the control valve 7 (that is, the discharge amount of the pump 2) based on inputted information and an incorporated program. With such control, the pressure and flow rate of working oil to be supplied to the engine are controlled. The ECU 6 includes a reception portion, a central processing unit (CPU), a read only memory (ROM), a random access memory (RAM), and a drive circuit. The ECU 6 includes, as a main component, a microcomputer where these components are connected with each other through bidirectional common buses. The reception portion receives detected values of the pressure sensor 51 and the rotational speed sensor 52, and other information about engine operation conditions (oil temperature, water temperature, engine load and the like). The ROM is a memory portion which stores control programs, map data and the like. The CPU is an arithmetic operation portion which performs an arithmetic operation using the information inputted from the reception portion based on a control program which is read out. The CPU performs arithmetic operations for values, such as an electric current to be supplied to the control valve 7 (solenoid portion 9). The CPU outputs a control signal which corresponds to the result of the arithmetic operation to the drive circuit. The drive circuit controls an electric current to be supplied to the solenoid such that the drive circuit supplies electric power to the solenoid in response to the control signal outputted from the CPU. The drive circuit is a PWM control circuit, and causes the pulse width (duty ratio D) of a signal for driving the solenoid to be varied in response to the control signal.

During the operation of the engine, the control program is performed so that the control valve 7 (pump 2) is controlled. The ECU 6 causes a value (duty ratio D) of an electric current to be supplied to the solenoid to be varied such that the difference between a main gallery hydraulic pressure P and a predetermined required value P* falls within a predetermined range at any engine speed Ne within a predetermined range of rotational speed of the engine (Ne≥Ne1). Ne1 is a rotational speed which is set in advance. The required value P* is a hydraulic pressure, such as a hydraulic pressure required for operating the variable valve device, a hydraulic pressure required by an oil jet for cooling an engine piston, or a hydraulic pressure required for lubricating a bearing of the crankshaft. The required value P* is set in advance as an ideal value which corresponds to an engine operation condition, such as an engine speed Ne. The ROM of the ECU 6 stores, in the form of a map, duty ratios D and required values P* which are caused to be varied for respective engine speeds Ne (according to the engine operation conditions). The ECU 6 causes a duty ratio D to be varied according to an engine speed Ne based on the map. The map may set a discharge pressure, an oil temperature, a water temperature, an engine load and the like as parameters, for example.

Next, the manner of operation is described. The cam ring 24 accommodates the rotor 22 and the plurality of vanes 23 so that a plurality of pump chambers (working chambers) 28 are defined. The rotor 22 and the plurality of vanes 23 function as elements (pump structures) which constitute the pump 2. Each working chamber 28 is formed (defined) by the outer peripheral surface 220 of the rotor 22, two vanes 23 disposed adjacent to each other, the inner peripheral surface 240 of the cam ring, the bottom surface of the pump accommodating chamber 200, and the side surface of the cover. The volume of each of the working chambers 28 is variable with the rotation. The volume of each working chamber 28 increases and decreases with the rotation and hence, the plurality of working chambers 28 function as a pump. Within a range which overlaps with the intake port 202 (intake region), the volume of the working chamber 28 increases according to the rotation, and the working chamber 28 takes in working oil through the intake port 202. Within a range which overlaps with the discharge port 204 (discharge region), the volume of the working chamber 28 decreases, and the working chamber 28 discharges working oil to the discharge port 204. The theoretical discharge amount (a discharge amount per one rotation), that is capacity, of the pump 2 is determined by the difference between the maximum volume and the minimum volume of the working chamber 28. The rotation of the crankshaft is transmitted to the drive shaft 21 of the pump 2 by way of the chain and the gear. The drive shaft 21 rotationally drives the rotor 22. The rotor 22 rotates in the counterclockwise direction in FIG. 2. When the pump structures including the rotor 22 are rotationally driven, working oil, which is introduced through the intake opening 201, is discharged through the discharge opening 203. A discharge pressure is introduced into the back pressure chambers 223, and pushes out the vanes 23 from the slits 222, thus improving liquid tightness of the working chambers 28. Also in the case where an engine speed is low so that a centrifugal force and a pressure in the back pressure chambers 223 are low, the annular member 230 pushes out the vanes 23 from the slits 222, thus improving the liquid tightness of the working chambers 28. The pump 2 sucks working oil from the oil pan 400 through the intake passage 40, and discharges the working oil to the discharge passage 41. The pump 2 pressure-feeds working oil to respective portions of the engine through the discharge passage 41 and the main gallery 42. When the pressure (discharge pressure) in the discharge passage 41 assumes a predetermined high pressure, the relief valve 440 opens so as to drain working oil through the relief passage 44 from the discharge passage 41.

The amount of variation in the volume of the working chamber 28 (the difference between the maximum volume and the minimum volume) is variable. The cam ring 24 is a member which is movable (movable member) in the pump accommodating chamber 200, and the cam ring 24 can perform a rotational oscillation about the pin 27. The pin 27 functions as a pivot portion (fulcrum) disposed in the pump accommodating chamber 200. The cam ring 24 performs a rotational oscillation so that the difference (amount of eccentricity Δ) between the axis (center of rotation) 22P of the rotor 22 and the axis (center) 24P of the inner peripheral surface 240 of the cam ring varies. Varying the amount of eccentricity Δ varies the amount of increase or decrease in volume (amount of variation in volume) of each of the plurality of working chambers 28 at the time of rotating the rotor 22 and the plurality of vanes 23. That is, the pump 2 is a variable capacity pump. Accordingly, increasing the amount of eccentricity Δ allows capacity to be increased, and reducing the amount of eccentricity Δ allows capacity to be decreased. Further, the volume of the first control chamber 291 and the volume of the second control chamber 292 can be varied with the movement of the cam ring 24.

The cam ring 24 is biased by the spring 25 to one side (to the side where the amount of increase or decrease in volume of each of the plurality of working chambers 28 increases, and the amount of eccentricity Δ increases) in the rotational direction about the pin 27. This spring force is assumed as "Fs". The cam ring 24 receives the pressure of working oil in the first control chamber 291. The first region 246 of the outer peripheral surface 245 of the cam ring functions as a pressure receiving surface which receives a pressure in the first control chamber 291. The cam ring 24 is biased to the other side (to the side where the amount of eccentricity Δ decreases) in the rotational direction about the pin 27 by the above-mentioned hydraulic pressure. A force generated by this hydraulic pressure (hydraulic pressure force) is assumed as "Fp1". The volume of the first control chamber 291 increases with the movement of the cam ring 24 to the other side (the direction opposing the biasing force Fs of the spring 25) in the above-mentioned rotational direction. The cam ring 24 receives the pressure of working oil in the second control chamber 292. The second region 247 of the outer peripheral surface 245 of the cam ring functions as a pressure receiving surface which receives a pressure in the second control chamber 292. The cam ring 24 is biased to one side in the above-mentioned rotational direction by the above-mentioned hydraulic pressure. A force generated by this hydraulic pressure (hydraulic pressure force) is assumed as "Fp2". The volume of the second control chamber 292 increases with the movement of the cam ring 24 to one side (the same direction as the biasing force Fs) in the above-mentioned rotational direction. The position of the cam ring 24 in the rotational direction (the amount of eccentricity Δ, that is, capacity) is mainly determined by hydraulic pressure force Fp1, hydraulic pressure force Fp2, and biasing force Fs. When a hydraulic pressure force Fp1 becomes larger than the sum of hydraulic pressure force Fp2 and biasing force Fs (Fp2+Fs), the cam ring 24 oscillates to the other side in the above-mentioned rotational direction so that the amount of eccentricity Δ (capacity) reduces. When a hydraulic pressure force Fp1 becomes smaller than the sum of hydraulic pressure force Fp2 and biasing force Fs (Fp2+Fs), the cam ring 24 oscillates to one side in the above-mentioned rotational direction so that the amount of eccentricity Δ (capacity) increases.

Working oil discharged through the discharge opening 203 (hydraulic pressure P of the main gallery 42) is introduced into the first control chamber 291 through the first feedback passage 431. Working oil discharged through the discharge opening 203 (main gallery hydraulic pressure P) may be introduced into the second control chamber 292 through the second feedback passage 432 (the supply passage 433, the control valve 7, and the communication passage 435). Working oil in the second control chamber 292 may be drained through the drainage passage 435. The control valve 7 can control an introduction of working oil into the second control chamber 292 and drainage of working oil from the second control chamber 292. The spool 81 moves so as to switch the connection state of the passage. To be more specific, the first land portion 811 causes the opening area of the supply port 803 to be varied, and the second land portion 812 causes the opening area of the drainage port 806 to be varied. The opening of the communication port 805 is not closed by either land portion. The space 807 forms a passage for working oil. Moving the spool 81 switches between establishing and shutting off of the connection between the communication passage 435 and the supply passage 433, or switches between establishing and shutting off of the connection between the communication passage 435 and the drainage passage 436. In performing switching, it is assumed as a basic mode that the communication passage 435 communicates with either one of the supply passage 433 or the drainage passage 436, and is shut off to the other of the supply passage 433 or the drainage passage 436. To be more specific, in a state where the first land portion 811 completely closes the opening of the supply port 803 which is open to the space 807, the second land portion 812 causes the drainage port 806 to be open to the space 807. In a state where the second land portion 812 completely closes the opening of the drainage port 806 which is open to the space 807, the first land portion 811 causes the supply port 803 to be open to the space 807. The opening of the communication port 805 which is open to the space 807 is always fully open. In performing switching, there may be a case where the communication passage 435 communicates with or shuts off to both of the supply passage 433 and the drainage passage 436 (temporarily at a predetermined position of the spool 81). There may also be a case where the opening of the communication port 805 which is open to the space 807 is partially closed. These cases are determined by tuning.

The spool 81 switches the connection state of the passage, thus switching between establishing and shutting off of the communication between the discharge opening 203 and the second control chamber 292 (through the communication passage 435 and the supply passage 433) and, switching between establishing and shutting off of the communication between the second control chamber 292 and the oil pan 400 (through the communication passage 435 and the drainage passage 436). When the spool 81 is at an initial position, the communication passage 435 and the supply passage 433 are connected with each other, and the discharge opening 203 of the pump 2 and the second control chamber 292 are in a communication state and hence, working oil discharged through the discharge opening 203 is introduced into the second control chamber 292 (first state). When the spool 81 moves to one side in the axial direction from the initial position, a state is brought about where the communication passage 435 and the drainage passage 436 are connected with each other so that the second control chamber 292 and the oil pan 400 are communicated with each other and hence, working oil is drained from the inside of the second control chamber 292 (second state). The second state is prevented during the first state. The first state is prevented during the second state. Accordingly, when the amount of working oil which is discharged through the discharge opening 203 and introduced into the second control chamber 292 increases, the amount of working oil which is drained from the inside of the second control chamber 292 decreases. When the amount of working oil which is discharged through the discharge opening 203 and introduced into the second control chamber 292 decreases, the amount of working oil which is drained from the inside of the second control chamber 292 increases. The working oil discharged through the discharge opening 203 of the pump 2 (main gallery hydraulic pressure P) is introduced to the inside (space 808) of the cylinder 80 through the control passage 434 (control port 804). With the reception of the pressure P of the working oil in the space 808, the spool 81 (first land portion 811) is biased to one side in the axial direction by this hydraulic pressure P. A force generated by this hydraulic pressure P (hydraulic pressure force) is assumed as "fp". The space 808 functions as a control chamber which generates hydraulic pressure force fp. The spool 81 is also biased to the other side in the axial direction by the spring 82. This spring force is assumed as "fs". When an electromagnetic force fm is zero, the position of the spool 81 in the axial direction with respect to the cylinder 80 is mainly determined by hydraulic pressure force fp and spring force fs. Hydraulic pressure force fp varies according to the amount of working oil (main gallery hydraulic pressure P) discharged through the discharge opening 203. When a hydraulic pressure force fp becomes larger than a spring force fs, the spool 81 moves to one side in the axial direction, thus realizing the second state. When a hydraulic pressure force fp becomes smaller than a spring force fs, the spool 81 moves to the other side in the axial direction, thus realizing the first state.

Figure 5:
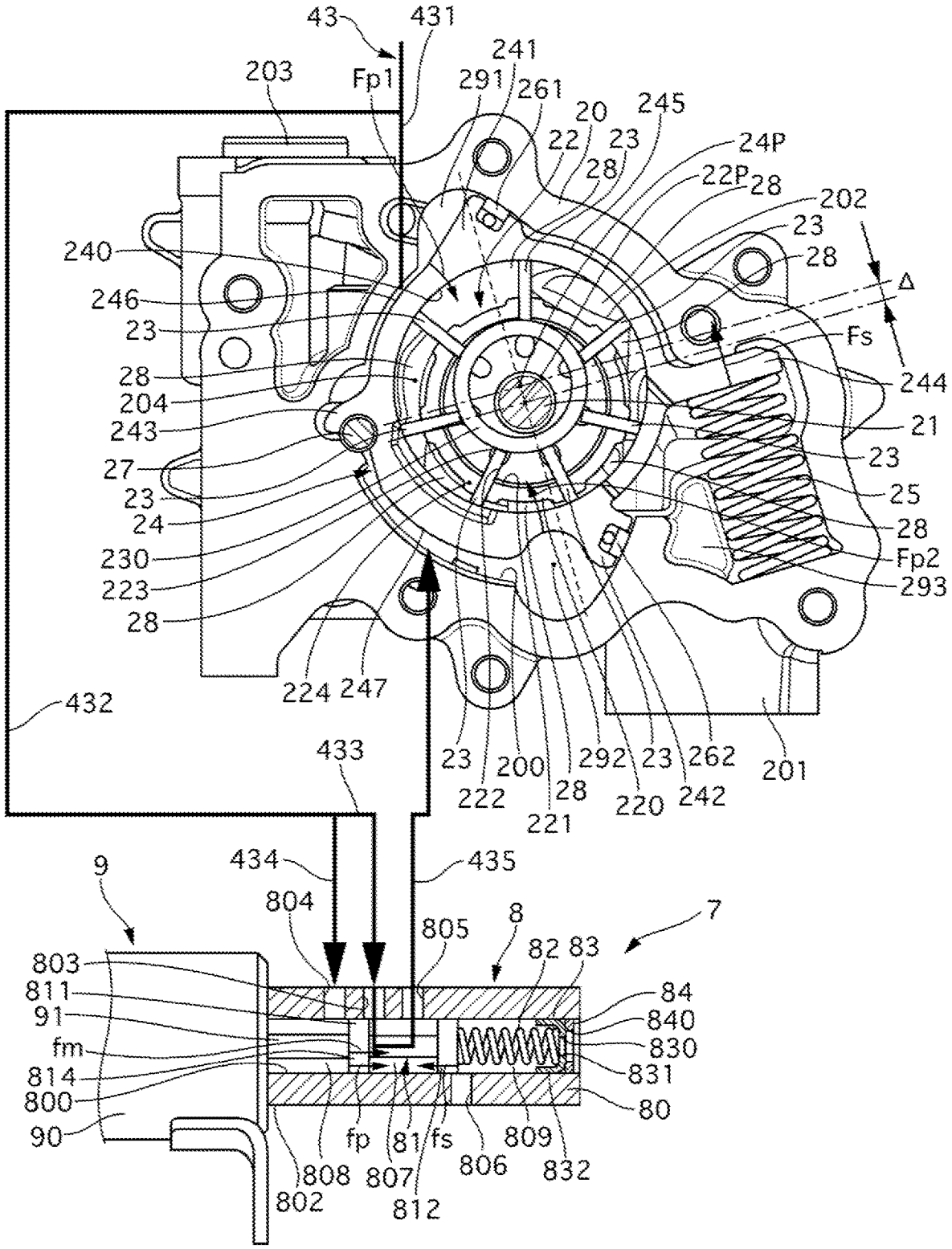
FIG. 5 is a view showing an operation state of the pump of the first embodiment.
Figure 6:
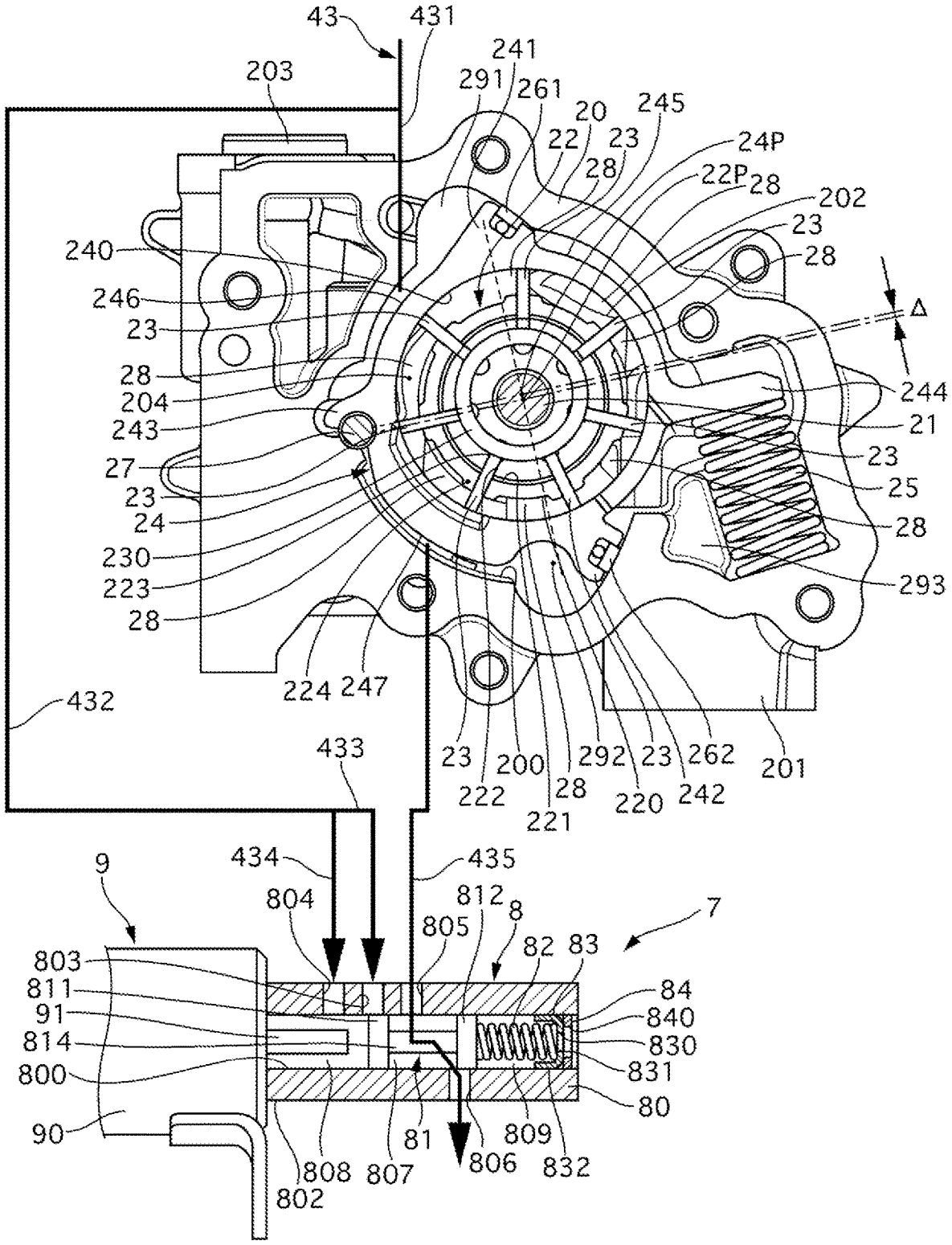
FIG. 6 is a view showing the operation state of the pump of the first embodiment.
Figure 8:
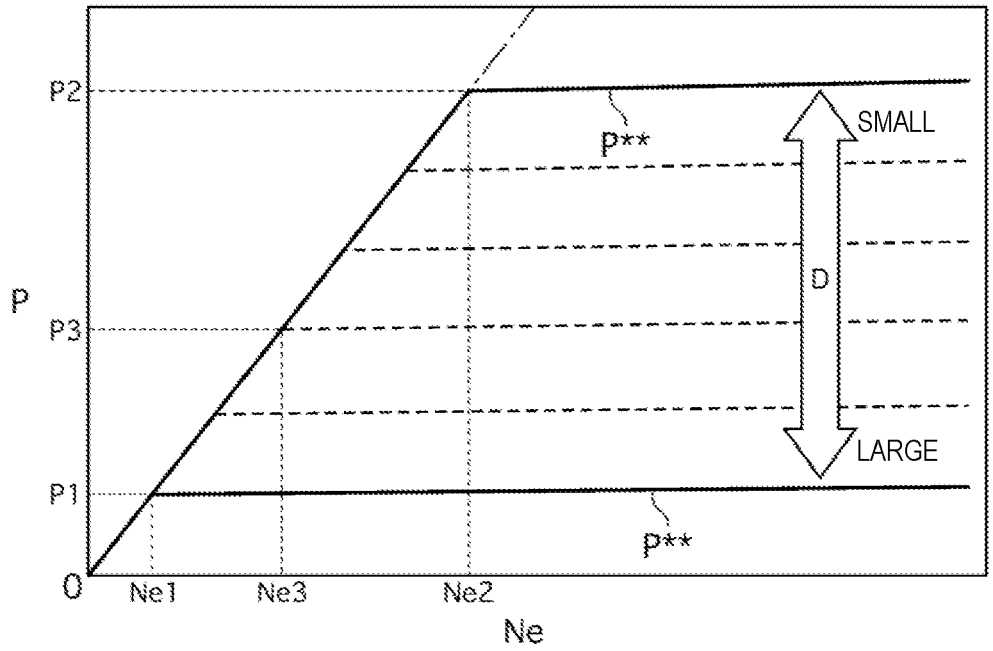
FIG. 8 is a graph showing the relationship between an engine speed and a discharge pressure which are realized by the pump.

The description is made with respect to the operation of the control valve 7 and the operation of the cam ring 24 which is caused with this operation of the control valve 7 when the thrust fm of the solenoid is zero (duty ratio D is zero). In FIG. 5 and FIG. 6, a hydraulic pressure force fp acts on the spool 81 in the rightward direction, and a spring force fs acts on the spool 81 in the leftward direction. When engine speed Ne is equal to or less than a predetermined value Ne2, the rotational speed of the pump 2 is also equal to or less than a predetermined value so that a main gallery hydraulic pressure P is equal to or less than a predetermined value P2. The main gallery hydraulic pressure P is equal to or less than the predetermined value P2 so that a hydraulic pressure force fp is equal to or less than a predetermined value, and a hydraulic pressure force fp is equal to or less than a spring force fs (set load of the spring 82). As shown in FIG. 5, the spool 81 is at an initial position where the spool 81 is moved to the position closest to the other side in the axial direction. Accordingly, while the opening area of the supply port 803 which is open to the space 807 assumes the maximum set value, the opening of the drainage port 806 which is open to the space 807 is completely closed by the second land portion 812. The hydraulic pressure P introduced into the space 807 from the supply passage 433 is introduced into the second control chamber 292 without a pressure loss. The space 807 functions as a communication chamber where working oil flows through. The sum of hydraulic pressure force Fp2 and biasing force Fs (Fp2+Fs (the set load of the spring 25)) is larger than the hydraulic pressure force Fp1 which acts on the cam ring 24. Accordingly, the cam ring 24 is at a position where the cam ring 24 oscillates the most to one side in the rotational direction, thus maintaining the maximum amount of eccentricity Δ. As shown in FIG. 8, within a range where engine speed Ne is equal to or less than predetermined value Ne2, hydraulic pressure P (discharge flow rate) varies according to engine speed Ne at a constant gradient which corresponds to the maximum capacity.

When engine speed Ne is higher than predetermined value Ne2, the rotational speed of the pump 2 is also higher than a predetermined value. When main gallery hydraulic pressure P reaches predetermined value P2, hydraulic pressure force fp reaches a predetermined value so that the hydraulic pressure force fp becomes larger than a spring force fs (the set load of the spring 82). As shown in FIG. 6, the spool 81 slightly moves to one side in the axial direction from the initial position. The duty ratio D is zero and hence, an electromagnetic force fm does not act so that the rod 91 is separated from the spool 81. While the opening of the supply port 803 which is open to the space 807 is completely closed by the first land portion 811, the second land portion 812 also moves and hence, the drainage port 806 is open to the space 807. That is, connection destination of the second control chamber 292 is switched from the supply port 803 to the drainage port 806. Working oil is drained from the second control chamber 292 through the space 807 and the drainage passage 436 and hence, a hydraulic pressure in the second control chamber 292 drops. The sum of hydraulic pressure force Fp2 and biasing force Fs (Fp2+Fs) which act on the cam ring 24 becomes smaller than hydraulic pressure force Fp1 and hence, the cam ring 24 oscillates to the other side in the rotational direction so that the amount of eccentricity Δ decreases. When the amount of eccentricity Δ (capacity) decreases, the discharge flow rate decreases so that main gallery hydraulic pressure P drops. When main gallery hydraulic pressure P becomes equal to or less than predetermined value P2, a state shown in FIG. 5 is brought about again and hence, hydraulic pressure P is introduced into the second control chamber 292 so that hydraulic pressure force Fp2 increases, thus increasing the amount of eccentricity Δ. When the amount of eccentricity Δ (capacity) increases, the discharge flow rate increases so that the main gallery hydraulic pressure P rises. As described above, supply and discharge of working oil to and from the second control chamber 292 are alternately switched such that the spool 81 is operated so as to reduce hydraulic pressure P when the hydraulic pressure P rises with respect to predetermined value P2, while the spool 81 is operated so as to increase hydraulic pressure P when the hydraulic pressure P drops with respect to predetermined value P2. With such operations, as shown in FIG. 8, within a range where engine speed Ne is higher than predetermined value Ne2, hydraulic pressure P is maintained (controlled) at predetermined value P2 or around predetermined value P2 regardless of engine speed Ne.

The solenoid can continuously change thrust fin. As shown in FIG. 4, thrust fm varies corresponding to duty ratio D. The solenoid functions as a proportional electromagnet which can continuously control thrust fin corresponding to a current value (duty ratio D). Basically, thrust fm increases when duty ratio D is increased. By changing the magnitude of thrust fin, main gallery hydraulic pressure (the pressure of working oil discharged through the discharge opening 203) P at which movement of the spool 81 is started can be varied. In other words, it is possible to vary hydraulic pressure P which is controlled (maintained) at a constant value regardless of engine speed Ne. That is, the position of the spool 81 in the axial direction with respect to the cylinder 80 is determined by thrust fm, hydraulic pressure force fp, and spring force fs. When the sum of thrust fin and hydraulic pressure force fp (fm+fp) becomes larger than a spring force fs, the spool 81 moves to one side in the axial direction. When the sum of thrust fm and hydraulic pressure force fp (fm+fp) becomes smaller than a spring force fs, the spool 81 moves to the other side in the axial direction. Thrust fm is controlled such that the thrust fm assists hydraulic pressure force fp, thus allowing the spool 81 to be moved to one side in the axial direction with lower hydraulic pressure P (with lower hydraulic pressure force fp). That is, a hydraulic pressure (control hydraulic pressure) P, which is controlled so as to maintain a fixed value by the operation of the spool 81, is lowered. Accordingly, as shown in FIG. 8, it becomes possible to control main gallery hydraulic pressure P to a value equal to or less than predetermined value P2, corresponding to duty ratio D (the magnitude of thrust fm). The larger a duty ratio D, the lower a control hydraulic pressure P becomes. The smaller a duty ratio D, the higher a control hydraulic pressure P becomes. The solenoid portion 9 has a function of substantially changing (controlling) the load of the spring 82 by changing thrust fm.

Figure 7:
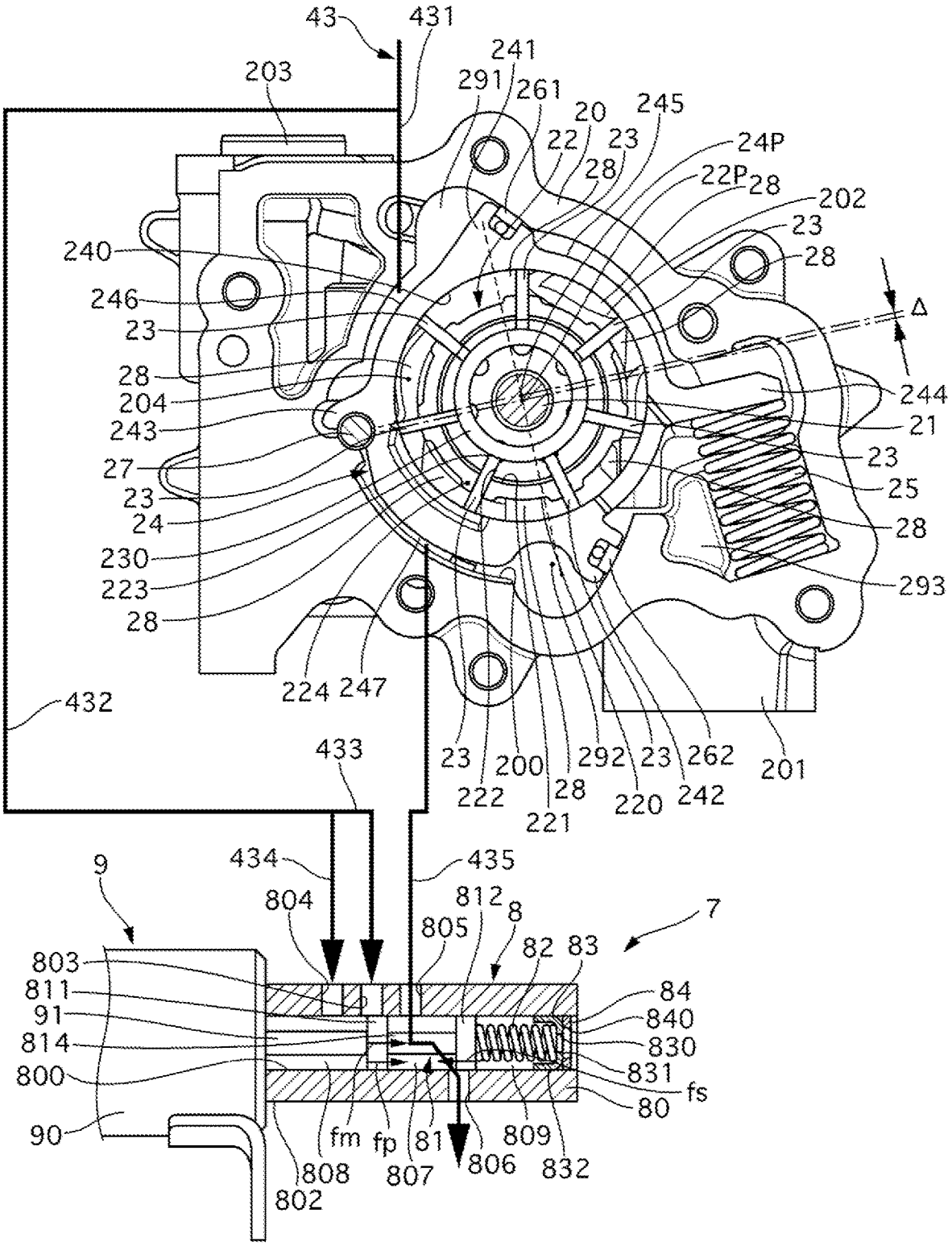
FIG. 7 is a view showing the operation state of the pump of the first embodiment.

The description is made with respect to the operation of the control valve 7 and the operation of the cam ring 24 which is caused with this operation of the control valve 7 when the thrust fm of the solenoid is larger than zero (duty ratio D is larger than the predetermined value D1). The operation state when engine speed Ne is equal to or less than predetermined value Ne3 is equal to the operation state shown in FIG. 5. In this state, Ne1<Ne3<Ne2 is established. Thrust fm proportional to duty ratio D (current value) is generated and hence, in the drawing, the rod 91 pushes the spool 81 in the rightward direction. This state means that thrust fin assists hydraulic pressure force fp. When the sum of thrust fm and hydraulic pressure force fp (fm+fp) is equal to or less than a spring force fs (the set load of the spring 82), as shown in FIG. 5, the spool 81 is at the initial position. The cam ring 24 maintains the maximum amount of eccentricity Δ. As shown in FIG. 8, within a range where engine speed Ne is equal to or less than predetermined value Ne3, hydraulic pressure P (discharge flow rate) varies according to engine speed Ne at a constant gradient which corresponds to the maximum capacity. When the hydraulic pressure P reaches P3 in a state where engine speed Ne is higher than predetermined value Ne3, hydraulic pressure force fp reaches a predetermined value, and the sum of thrust fm and hydraulic pressure force fp (fm+fp) becomes larger than a spring force fs (the set load of the spring 82). As shown in FIG. 7, the spool 81 moves to one side in the axial direction from the initial position. The duty ratio D is larger than the predetermined value D1 and hence, the rod 91 is brought into contact with the spool 81 so that thrust fin acts on the spool 81. Working oil is drained from the second control chamber 292, thus decreasing an amount of eccentricity Δ. When the hydraulic pressure P becomes equal to or less than P3, a state shown in FIG. 5 is brought about again and hence, hydraulic pressure P is introduced into the second control chamber 292, thus increasing eccentricity Δ. Accordingly, as shown in FIG. 8, within a range where engine speed Ne is higher than predetermined value Ne3, hydraulic pressure P is maintained (controlled) at P3 or around P3 regardless of engine speed Ne.

Figure 9:
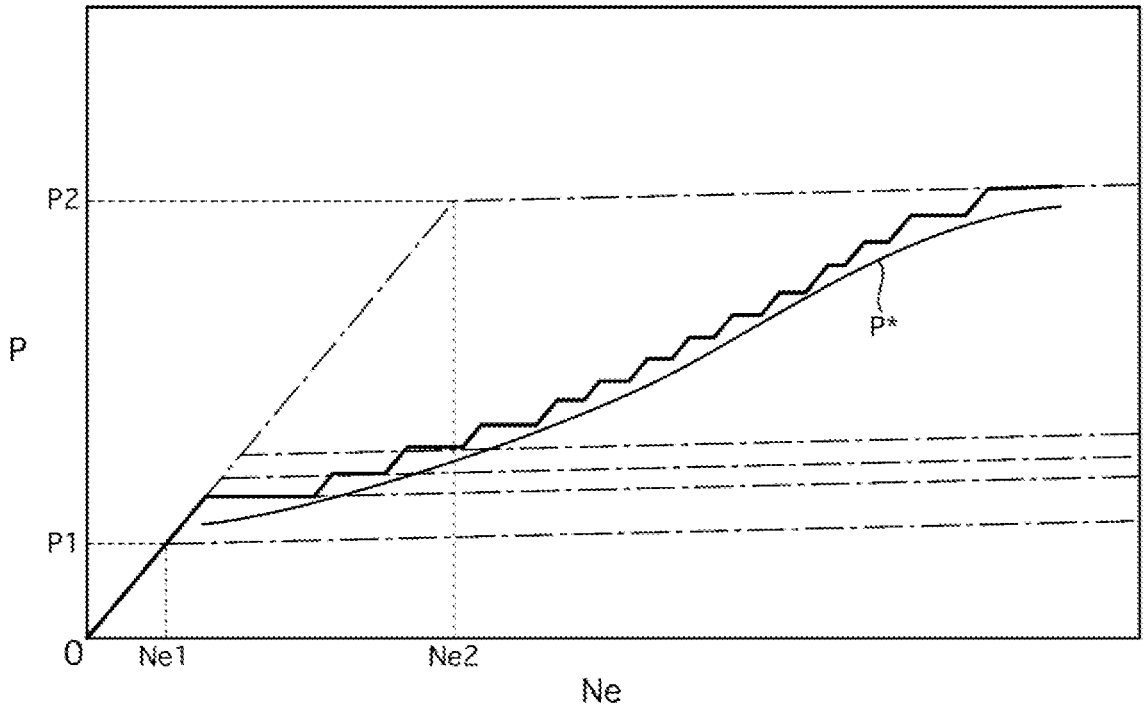
FIG. 9 is a graph showing one example of the relationship between the engine speed and the discharge pressure which are realized by the pump of the first embodiment.

Within a range where engine speed Ne is equal to or more than Ne1, the ECU 6 causes, according to the stored map, duty ratio D to be discretely varied (causes duty ratio D to be switched at a predetermined width) for each predetermined range of engine speed Ne. With such an operation, it is possible to realize the characteristic of a main gallery hydraulic pressure P with respect to engine speed Ne as indicated by a solid line in FIG. 9. Within a predetermined range of engine speed Ne where duty ratio D assumes a fixed value, control hydraulic pressure P** (fixed value) which corresponds to this duty ratio D is realized. Within a range of engine speed Ne where duty ratio D is switched, the amount of eccentricity Δ becomes the maximum so that main gallery hydraulic pressure P varies according to engine speed Ne at a constant gradient which corresponds to the maximum capacity. This operation is repeated plurality of times so that the above-mentioned characteristic having a stairs-like shape is realized. Duty ratio D is set in advance with respect to engine speed Ne such that the above-mentioned characteristic approximates a predetermined required characteristic. For example, variation in duty ratio D with respect to engine speed Ne is set such that the difference between main gallery hydraulic pressure P having the above-mentioned realized characteristic and main gallery hydraulic pressure P having the above-mentioned required characteristic (required value P*) falls within a predetermined range at any engine speed Ne (≥Ne1). As described above, the solenoid can change, according to duty ratio D (the value of an electric current to be supplied), the magnitude of an electromagnetic force fm which biases the spool 81 in the axial direction. Accordingly, varying duty ratio D according to engine speed Ne allows main gallery hydraulic pressure P (control hydraulic pressure P**) and discharge flow rate to be freely varied (controlled). Characteristics of main gallery hydraulic pressure P and discharge flow rate with respect to engine speed Ne can be easily caused to approximate desired characteristics. Accordingly, power loss caused due to unnecessary rise in discharge pressure (increase in flow rate) can be suppressed so that fuel economy can be improved. In the above-mentioned description, characteristic is described to have a stairs-like shape for facilitating understanding of the description. However, in an actual control, numerous number of stairs may be formed, that is, main gallery hydraulic pressure P may be steplessly controlled according to an engine speed Ne, thus substantially continuously controlling the main gallery hydraulic pressure P along required hydraulic pressure P*.

When engine speed Ne is less than Ne1 which is a value set in advance, the ECU 6 does not supply an electric current to the solenoid. When engine speed Ne is less than Ne1, working oil discharged through the discharge opening 203 is introduced into the second control chamber 292. Accordingly, working oil can be discharged through the discharge opening 203 with the amount of eccentricity Δ being in a maximum state. Therefore, after the engine is started, it is possible to cause discharge pressure to rapidly rise (to ensure operational responsiveness of the variable valve device, for example) according to an increase in engine speed.

The spool 81 can control the introduction of working oil into the second control chamber 292 such that the spool 81 is biased to one side in the axial direction by the pressure of working oil introduced into the cylinder 80 through the discharge opening 203, thus moving in the cylinder 80.

Accordingly, a discharge pressure acts on the spool 81 as a pilot pressure and hence, the operation of the spool 81 (introduction of working oil to the second control chamber 292) is feedback controlled whereby the discharge pressure can be automatically controlled to a control hydraulic pressure P. The spool 81 can realize a first state, where working oil discharged through the discharge opening 203 is introduced into the second control chamber 292, and a second state, where working oil is drained from the inside of the second control chamber 292. The spool 81 realizes the second state by moving to one side in the axial direction. Accordingly, when a discharge pressure P acts on the spool 81 thus moving the spool 81 to one side in the axial direction, working oil is drained from the inside of the second control chamber 292 whereby capacity may decrease (discharge pressure P may drop). With such operations, a discharge pressure P can be controlled to a control hydraulic pressure P. At this point of operation, control of discharge pressure P is performed by switching the port of the control valve 7 and hence, the control of discharge pressure P is not affected by the spring constant of the spring 25 of the cam ring 24. Further, the control of discharge pressure P is performed within a narrow range of stroke of the spool 81 which performs switching of the port and hence, the control of discharge pressure P is also not significantly affected by the spring constant of the spring 82 of the control valve 7. Accordingly, control hydraulic pressure P** can be easily allowed to have flat characteristic with respect to variation in engine speed Ne.

To be more specific, the cylinder 80 has the supply port 803 which allows working oil discharged through the discharge opening 203 to be introduced into the cylinder 80, the communication port 805 which allows the inside of the cylinder 80 and the second control chamber 292 to communicate with each other, and the drainage port 806 which allows working oil to be drained from the inside of the cylinder 80. The spool 81 includes the first land portion 811 which causes the opening area of the supply port 803 to be varied, and the second land portion 812 which causes the opening area of the drainage port 806 to be varied. With such a simple configuration of a spool valve, the valve portion 8 can control a pressure in the second control chamber 292. To be more specific, the cylinder 80 has: the supply port 803 (first supply opening) and the control port 804 (second supply opening) which communicate with the discharge opening 203; the communication port 805 which communicates with the second control chamber 292; and the drainage port 806 which communicates with the oil pan 400 (low pressure portion). The spool 81 moves in the cylinder 80 upon reception of the pressure of working oil introduced into the cylinder 80 from the discharge portion through the control port 804. With such movement, the spool 81 switches between establishing and shutting off of the communication between the discharge opening 203 and the second control chamber 292 through the supply port 803 and the communication port 805. At the same time, the spool 81 switches between establishing and shutting off of the communication between the second control chamber 292 and the oil pan 400 through the communication port 805 and the drainage port 806. With such a simple configuration of the spool valve, the valve portion 8 can control a pressure in the second control chamber 292. It is sufficient for the drainage port 806 to communicate with the low pressure portion. It is not limited to the configuration that the drainage port 806 communicates with the oil pan 400 (atmospheric pressure). For example, the drainage port 806 may communicate with the intake opening 201 side (where an intake negative pressure is generated).

By changing the magnitude of electromagnetic force fm, the solenoid varies a pressure P, of working oil to be discharged through the discharge opening 203, at which movement of the spool 81 is started. Accordingly, main gallery hydraulic pressure P controlled by the operation of the spool 81 (control hydraulic pressure P) can be varied by the solenoid. A member (rod 91) which allows the solenoid portion 9 to bias the spool 81 in the axial direction is provided separate from the spool 81. Accordingly, also in the case of malfunction where the solenoid portion 9 becomes inoperable due to disconnection or the like, the valve portion 8 can be automatically operated according to a hydraulic pressure. Therefore, a predetermined control hydraulic pressure P can be realized. The solenoid portion 9 biases the spool 81 to one side in the axial direction. With such an operation, a fail-safe function can be realized. That is, electromagnetic force fm acts in the same direction as hydraulic pressure force fp (in the direction which electromagnetic force fm assists hydraulic pressure force fp). As shown in FIG. 8, when electromagnetic force fm becomes small, the spool 81 moves to one side in the axial direction with a higher hydraulic pressure P (large hydraulic pressure force fp). That is, control hydraulic pressure P is increased. When electromagnetic force fm is zero, control hydraulic pressure P assumes predetermined value P2 which is the maximum discharge pressure. Accordingly, control hydraulic pressure P assumes a high pressure also in the case where there is a malfunction in the solenoid portion 9 and hence, working oil can be supplied to the engine at the maximum discharge pressure P2**. Accordingly, it is possible to suppress seizure or the like of the engine caused by lubrication failure.

When the amount of working oil which is discharged through the discharge opening 203 and introduced into the second control chamber 292 is increased, the control mechanism 3 decreases the amount of working oil to be drained from the inside of the second control chamber 292. When the amount of working oil which is discharged through the discharge opening 203 and introduced into the second control chamber 292 is decreased, the control mechanism 3 increases the amount of working oil to be drained from the inside of the second control chamber 292. Accordingly, the internal pressure of the second control chamber 292 can be sufficiently increased when desired to be increased, and the internal pressure of the second control chamber 292 can be sufficiently decreased when desired to be decreased. Therefore, the above-mentioned internal pressure can be controlled within a wide range from a low pressure to a high pressure. Further, the operation of the cam ring 24 becomes stable so that a discharge pressure also becomes stable. The area of the first region 246 of the outer peripheral surface 245 of the cam ring which faces the first control chamber 291 may be set equal to the area of the second region 246 of the outer peripheral surface 245 of the cam ring which faces the second control chamber 292. Alternatively, the area of the second region 247 may be set smaller than the area of the first region 246. In this embodiment, the area of the second region 247 (pressure receiving area) is larger than the area of the first region 246 (pressure receiving area). Accordingly, during the operation of the pump 2 at a high speed, a stable control hydraulic pressure P can be supplied. That is, when an engine speed (pump rotational speed) rises, air bubbles may be generated in working oil. When these air bubbles are collapsed in the working chamber 28 within the discharge region, there is a possibility that a balance of pressure which acts on the cam ring 24 is disturbed so that the behavior of the cam ring 24 becomes unstable, thus causing control hydraulic pressure P to drop. However, even when the pressure in the first control chamber 291 and the pressure in the second control chamber 292 are equal to each other, hydraulic pressure force Fp2 is larger than hydraulic pressure force Fp1. Accordingly, even if a balance of a pressure which acts on the cam ring 24 from the working chamber 28 is disturbed, the cam ring 24 is biased in the direction that an amount of eccentricity Δ increases, thus suppressing that the behavior of the cam ring 24 becomes unstable. Therefore, it is possible to suppress dropping of control hydraulic pressure P so that a stable control hydraulic pressure P can be supplied.

The volume of the first control chamber 291 increases with the movement of the cam ring 24 in the direction opposing the biasing force Fs of the spring 25. That is, hydraulic pressure force Fp1 acts in the direction opposite to the direction of biasing force Fs. The volume of the second control chamber 292 increases with the movement of the cam ring 24 in the same direction as biasing force Fs. That is, hydraulic pressure force Fp2 acts in the same direction as biasing force Fs, thus assisting the biasing force Fs. The operation of the cam ring 24 is decided by the magnitude relationship between hydraulic pressure force Fp1 and the sum of hydraulic pressure force Fp2 and biasing force Fs (Fp2+Fs). Accordingly, only a small biasing force Fs is required for causing the cam ring 24 to be operated in the direction that the amount of eccentricity Δ increases. The load of the spring 25 can be reduced. Accordingly, only a small hydraulic pressure force Fp1 is required for causing the cam ring 24 to be operated in the direction that the amount of eccentricity Δ decreases. That is, it is possible to lower a discharge pressure when the cam ring 24 is operated in the direction that the amount of eccentricity Δ decreases. In other words, a low control hydraulic pressure P can be realized. The cam ring 24 can be oscillated about a fulcrum disposed in the pump accommodating chamber 200. Accordingly, a range where the cam ring 24 is operated can be made compact, thus realizing the reduction in size of the pump 2**.

Lowering a pressure in the second control chamber 292 increases the difference between the pressure in the second control chamber 292 and the pressure at the discharge port 204. Accordingly, there is a possibility of increase in the amount of working oil to be leaked through a gap formed between the side surface of the cam ring 24 in the axial direction and the bottom surface of the pump accommodating chamber 200. However, the width in the radial direction of the second region 247 of the cam ring 24 is larger than the width in the radial direction of the first region 246. Accordingly, sealing property is improved more on the second control chamber 292 side than on the first control chamber 291 side and hence, the above-mentioned leakage can be suppressed. A discharge pressure is always introduced into the first control chamber 291 so that the difference between the pressure in the first control chamber 291 and the pressure at the discharge port 204 is small. Accordingly, sealing property is improved (the width in the radial direction is increased) only on the second control chamber 292 side and hence, unnecessary increase in weight is suppressed.

Second Embodiment

First, the configuration is described. The second embodiment differs from the first embodiment only with respect to the configuration of an ECU 6. The ECU 6 detects a main gallery hydraulic pressure P, and performs feedback control so as to cause the main gallery hydraulic pressure P to approximate a required value P*. The ECU 6 causes a duty ratio D (a current value to be supplied to a solenoid) to be varied such that the difference between the detected value and a required value P* for the main gallery hydraulic pressure P falls within a predetermined range. When engine speed Ne is less than Ne1, the ECU 6 sets a duty ratio D to zero. When engine speed Ne is equal to or more than Ne1, the ECU 6 calculates the difference ΔP (=P*−P) between a hydraulic pressure P detected (measured) by a pressure sensor 51 and a hydraulic pressure P* which an engine is required to have at any rotational speed Ne detected (measured) by a rotational speed sensor 52. When the magnitude of the difference ΔP is larger than a value ΔPset set in advance, a duty ratio D is caused to be varied such that the magnitude of the difference ΔP is reduced until the magnitude of the difference ΔP becomes equal to or less than the value ΔPset. When the magnitude of the difference ΔP is equal to or less than the value ΔPset, a duty ratio D is maintained (at a value immediately before a value at which the magnitude of the difference ΔP becomes equal to or less than the value ΔPset). Other configurations are equal to those in the first embodiment and hence, corresponding constitutional elements are given the same reference numerals, and the repeated description of such constitutional elements is omitted.

Accordingly, a control valve 7 and a cam ring 24 are operated such that the characteristic of a pressure P which corresponds to the variation in engine speed Ne approximates a required characteristic. A duty ratio D is feedback controlled according to a differential pressure ΔP and hence, while a pump 2 is prevented from being affected by leakage (leakage of working oil) or the like caused by a clearance formed between members, the characteristic of a hydraulic pressure P can be controlled more accurately. A method for feedback controlling a hydraulic pressure P to a required value P* is not limited to the above-mentioned method, and any method may be adopted. Setting a value ΔPset to a smaller value allows steps of a stairs-like shape to continuously change more finely in the same manner as the first embodiment. A value ΔPset may be set to zero. Hunting in control can be suppressed by setting a value ΔPset to a value other than zero, and by preventing a duty ratio D from being varied when the magnitude of difference ΔP is equal to or less than the value ΔPset. The manner of other operations and advantageous effects are equal to those in the first embodiment. The configuration of this embodiment is also applicable to any embodiment other than the first embodiment.

Third Embodiment

Figure 10:
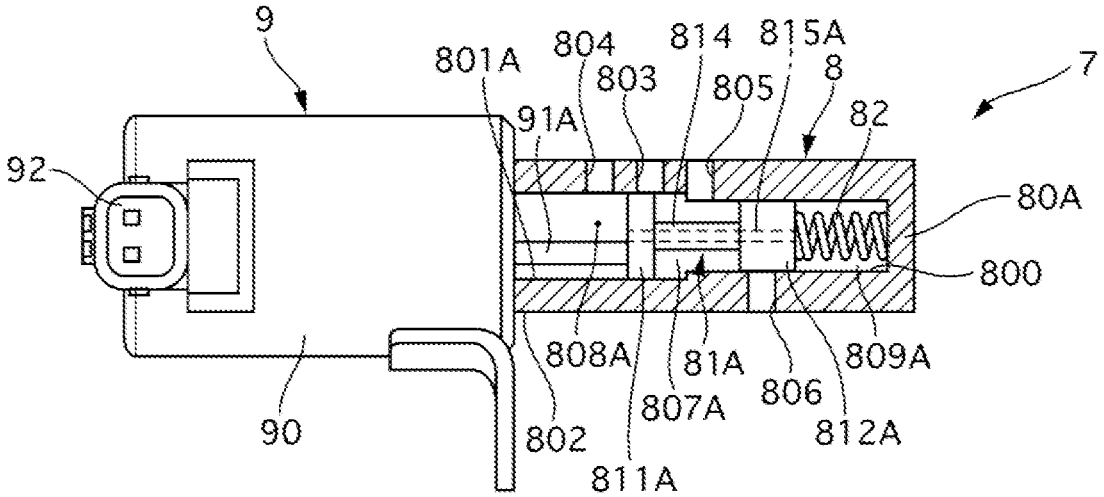
FIG. 10 is a schematic view of a control valve in a third embodiment.

First, the configuration is described. A control valve 7 is configured such that, as shown in FIG. 10, the end portion of a cylinder 80A of a valve portion 8 on one side in the axial direction is not open, but is closed. One end of a spring 82 is brought into contact with the above-mentioned end portion of the cylinder 80A. An inner peripheral surface 801A of the cylinder 80A on the other side in the axial direction has a larger diameter than an inner peripheral surface 800 of the cylinder 80A on one side in the axial direction. A supply port 803 and a control port 804 are open on the inner peripheral surface 801A of the cylinder. The diameter of a first land portion 811A is larger than the diameter of a second land portion 812A. The first land portion 811A is disposed on the inner peripheral surface 801A of the cylinder, and comes into slide contact with the inner peripheral surface 801A. A spool 81A has a hole 815A which penetrate the spool 81A in an axial direction. The hole 815A is disposed on the axis of the spool 81A. A rod 91A extends in the axial direction of the cylinder 80A, and is offset from (eccentric to) the axis of the inner peripheral surface 801A in the radial direction of the cylinder 80A. The rod 91A does not close the opening of the hole 815A on the end surface of the spool 81A (first land portion 811A) in the axial direction. A space 807A defined between the first land portion 811A and the second land portion 812A has a stepped cylindrical shape where cylinders having different diameters are aligned on the same axis. The hole 815A is always open to a space 808A defined between the first land portion 811A and a casing 90 of a solenoid portion 9, and to a space 809A defined between the second land portion 812A and the end portion of the cylinder 80A on one side in the axial direction. Other configurations are equal to those in the first embodiment and hence, corresponding constitutional elements are given the same reference numerals, and the repeated description of such constitutional elements is omitted.

Figure 11:
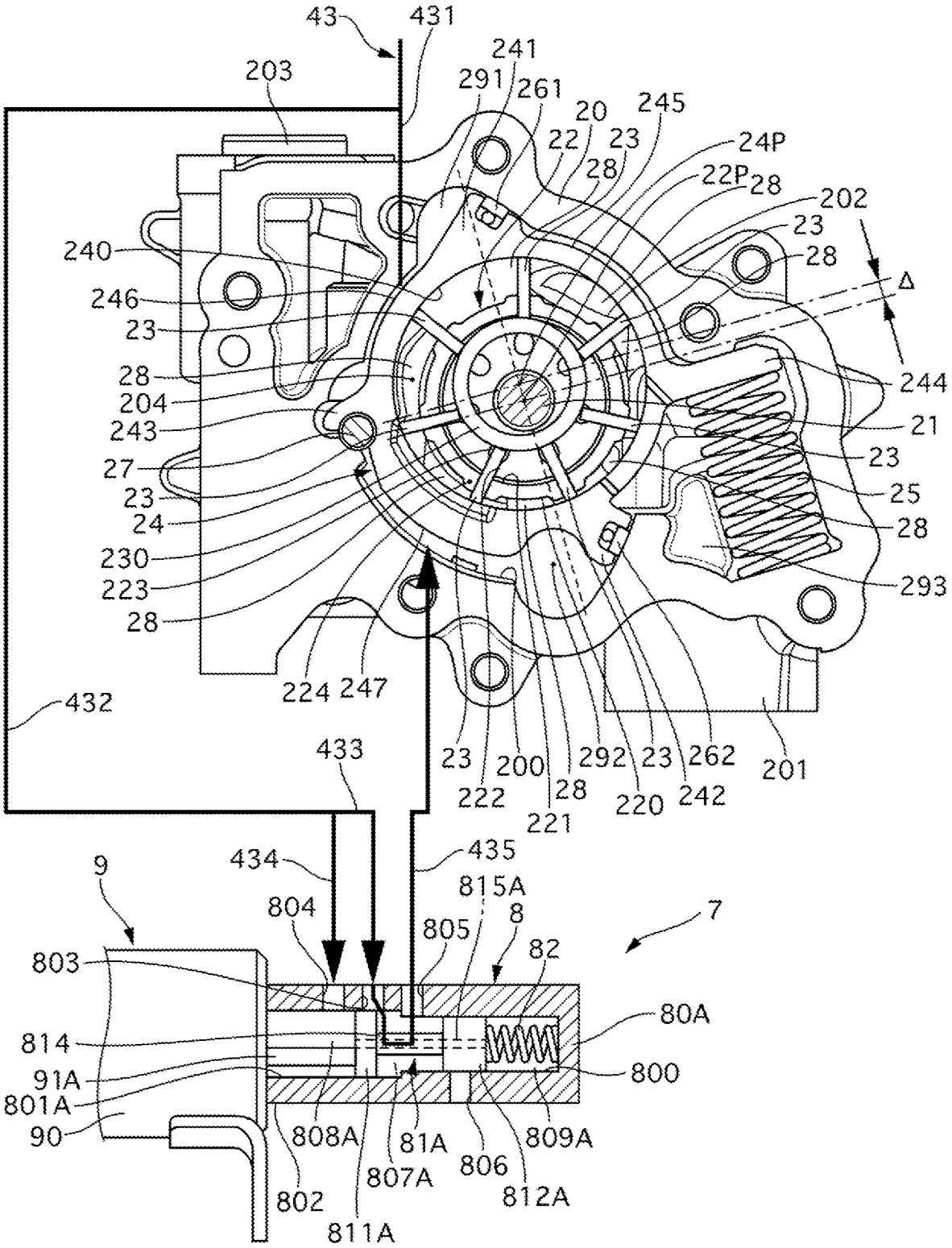
FIG. 11 is a view showing an operation state of a pump of the third embodiment.
Figure 12:
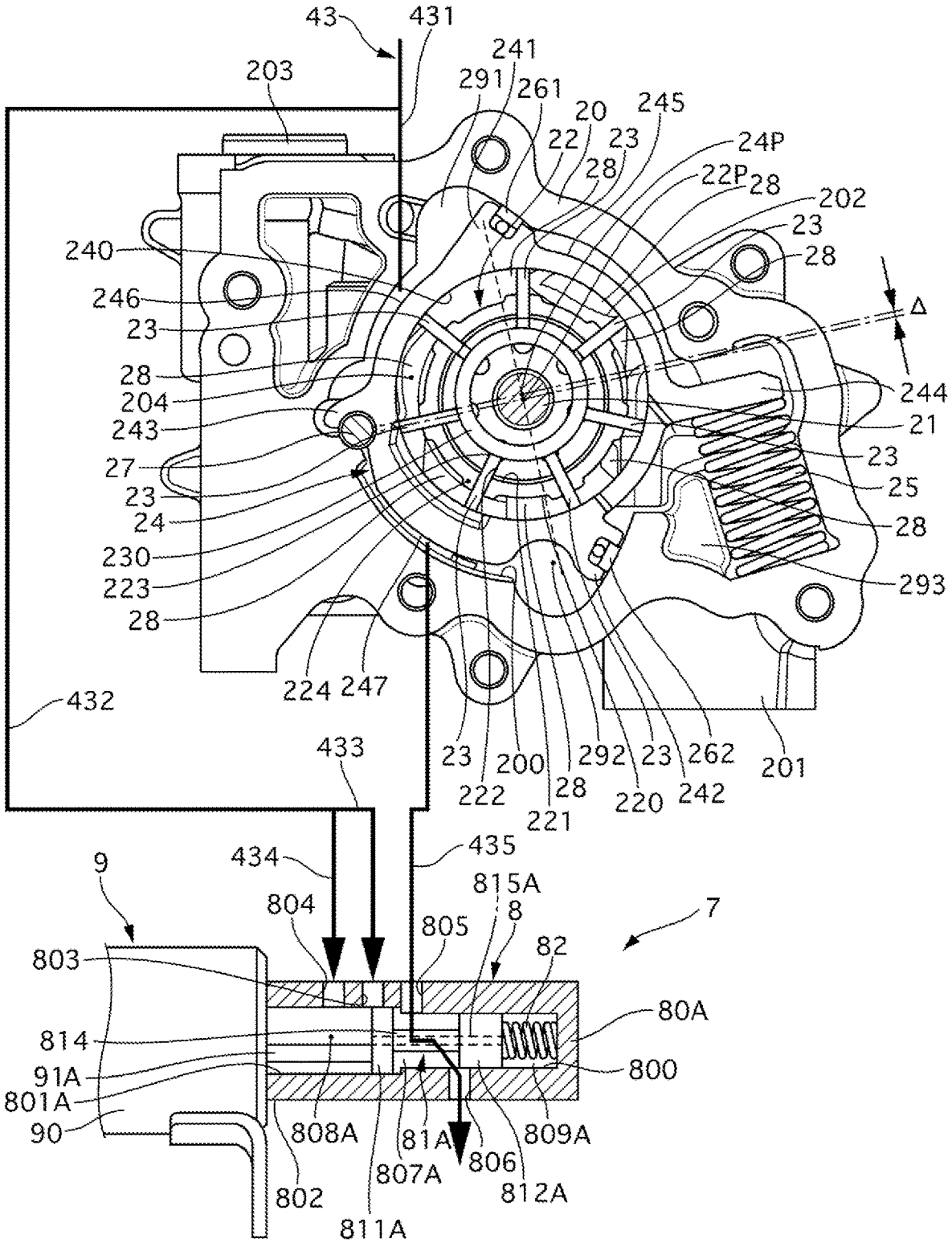
FIG. 12 is a view showing the operation state of the pump of the third embodiment.

Next, the manner of operation is described. The hole 815A functions as a communication hole which allows one side and the other side of the spool 81A in the axial direction to communicate with each other. Accordingly, the space 808A and the space 809A are made to communicate with each other, thus having the same pressure. The diameter of the first land portion 811A (the area of a surface which receives the pressure of working oil in the space 808A) is larger than the diameter of the second land portion 812A (the area which receives the pressure of working oil in the space 809A). Accordingly, when a hydraulic pressure p1 is generated in the spaces 808A, 809A, a hydraulic pressure force fp1 having a magnitude obtained by multiplying the above-mentioned difference in pressure receiving area between the first land portion 811A and the second land portion 812A by a hydraulic pressure p1 acts on the spool 81A on one side in the axial direction. Further, when a hydraulic pressure p2 is generated in the space 807A, a hydraulic pressure force fp2 having a magnitude obtained by multiplying the above-mentioned difference in pressure receiving area between the first land portion 811A and the second land portion 812A by a hydraulic pressure p2 acts on a spool 81S on the other side in the axial direction. The hydraulic pressure P2 is equal to or less than the hydraulic pressure p1. Accordingly, a hydraulic pressure force fp having a magnitude obtained by subtracting the hydraulic pressure force fp2 from the hydraulic pressure force fp1 acts on the spool 81A on one side in the axial direction. When the sum of thrust fm and hydraulic pressure force fp (fm+fp) is equal to or less than a spring force fs, as shown in FIG. 11, in the same manner as FIG. 5, the spool 81A is at an initial position so that the supply port 803 communicates with a communication port 805. The amount of eccentricity Δ becomes the maximum due to a hydraulic pressure P introduced into a second control chamber 292. When a hydraulic pressure P1 rises, thus causing the sum of thrust fm and hydraulic pressure force fp (fm+fp) to become larger than a spring force fs, as shown in FIG. 12, in the same manner as FIG. 6, the spool 81A moves to one side in the axial direction from the initial position so that a drainage port 806 communicates with the communication port 805. Working oil is drained from the second control chamber 292, thus decreasing an amount of eccentricity Δ.

Setting the above-mentioned difference in pressure receiving area to a small value makes a hydraulic pressure force fp small. It is possible to make the above-mentioned difference in pressure receiving area smaller than the pressure receiving area of the first land portion 811 in the space 808 in the first embodiment. With such a configuration, the magnitude of a hydraulic pressure force fp1 can be made smaller than the magnitude of a hydraulic pressure force fp in the first embodiment. Further, a hydraulic pressure force fp is reduced by an amount corresponding to a hydraulic pressure force fp2. Accordingly, the magnitude of a hydraulic pressure force fp can be made smaller than that in the first embodiment. Reducing the magnitude of a hydraulic pressure force fp can also reduce the set load of the spring 82. In this case, it is unnecessary to increase a thrust fin and hence, the solenoid portion 9 can be reduced in size and can save power. Further, the space 808 and the space 809 are always made to communicate with each other through the hole 815A and hence, even if the end portion of the cylinder 80A (the space 809A) on one side in the axial direction is closed, the spool 81A can be operated without being affected by a pressure in the space defined by the spool 81A and the inner peripheral surface 800 of the cylinder. Accordingly, a retainer 83 having a hole 830 and a stopper 84 having a hole 840 can be omitted so that the cylinder 80 can be simplified. The manner of other operations and advantageous effects are equal to those in the first embodiment. The configuration of this embodiment is also applicable to an embodiment other than the first embodiment.

Fourth Embodiment

Figure 13:
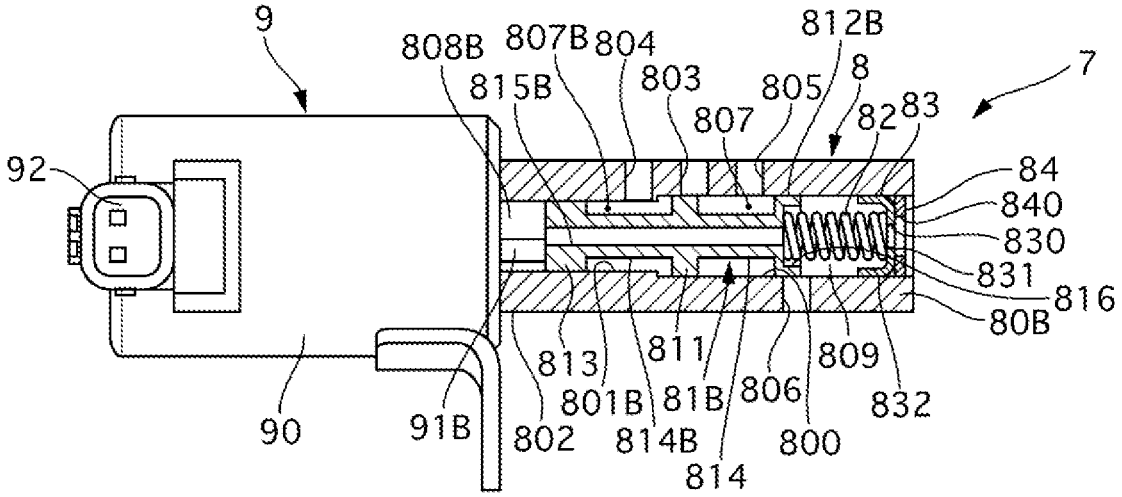
FIG. 13 is a schematic view of a control valve in a fourth embodiment.

First, the configuration is described. A control valve 7 is configured such that, as shown in FIG. 13, the diameter of an inner peripheral surface 801B of a cylinder 80B of a valve portion 8 on the other side in the axial direction is smaller than the diameter of an inner peripheral surface 800 on one side in the axial direction. A control port 804 is open on the inner peripheral surface 801B. A spool 81B includes a third land portion 813. A thin shaft portion 814B extends on the other side of a first land portion 811 in the axial direction. The third land portion 813 is disposed at the end of the thin shaft portion 814B on the other side in the axial direction. The diameter of the third land portion 813 is smaller than the diameters of the first land portion 811 and a second land portion 812B. The third land portion 813 is disposed on the inner peripheral surface 801B, and comes into slide contact with the inner peripheral surface 801B. A recessed portion 816 is formed on the end surface of the second land portion 812B on one side in the axial direction. The end of a spring 82 on the other side in the axial direction is disposed in the recessed portion 816. The spool 81B has a hole 815B which penetrates the spool 81B in the axial direction. The hole 815B is disposed on the axis of the spool 81B. In the same manner as the rod 91A in the third embodiment, a rod 91B is offset from the axis of the inner peripheral surface 801B. A space 807B is defined, as a liquid chamber, between the third land portion 813 and the first land portion 811 in the inside of the cylinder 80B, and a space 808B is defined, as a liquid chamber, between the third land portion 813 and a casing 90 in the inside of the cylinder 80B. The space 807B has a stepped cylindrical shape where cylinders having different diameters are aligned on the same axis. The control port 804 is always open to the space 807B, and a supply port 803 may be open to the space 807B. The hole 815B is always open to the space 808B and a space 809. Other configurations are equal to those in the first embodiment and hence, corresponding constitutional elements are given the same reference numerals, and the repeated description of such constitutional elements is omitted.

Figure 14:
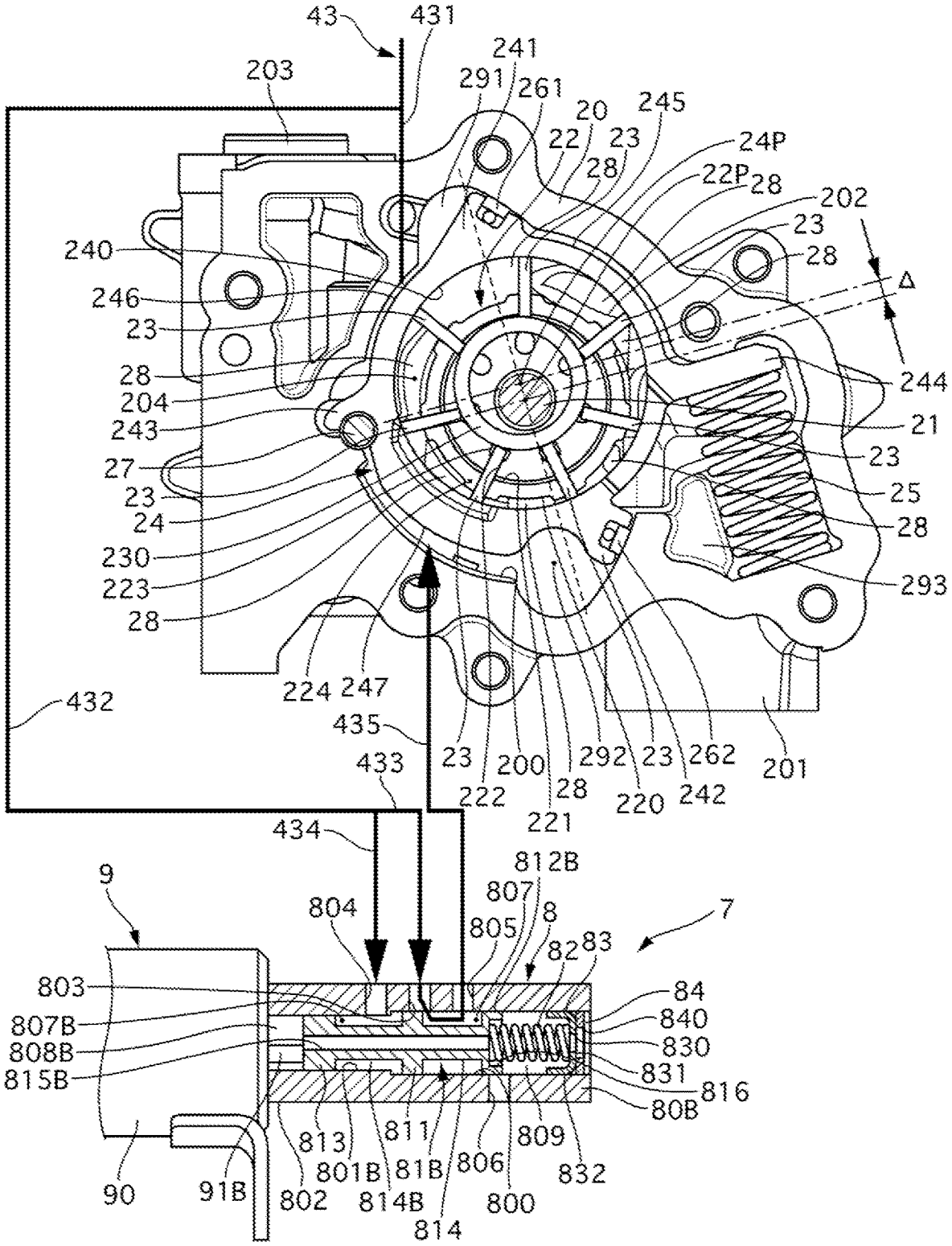
FIG. 14 is a view showing an operation state of a pump of the fourth embodiment.
Figure 15:
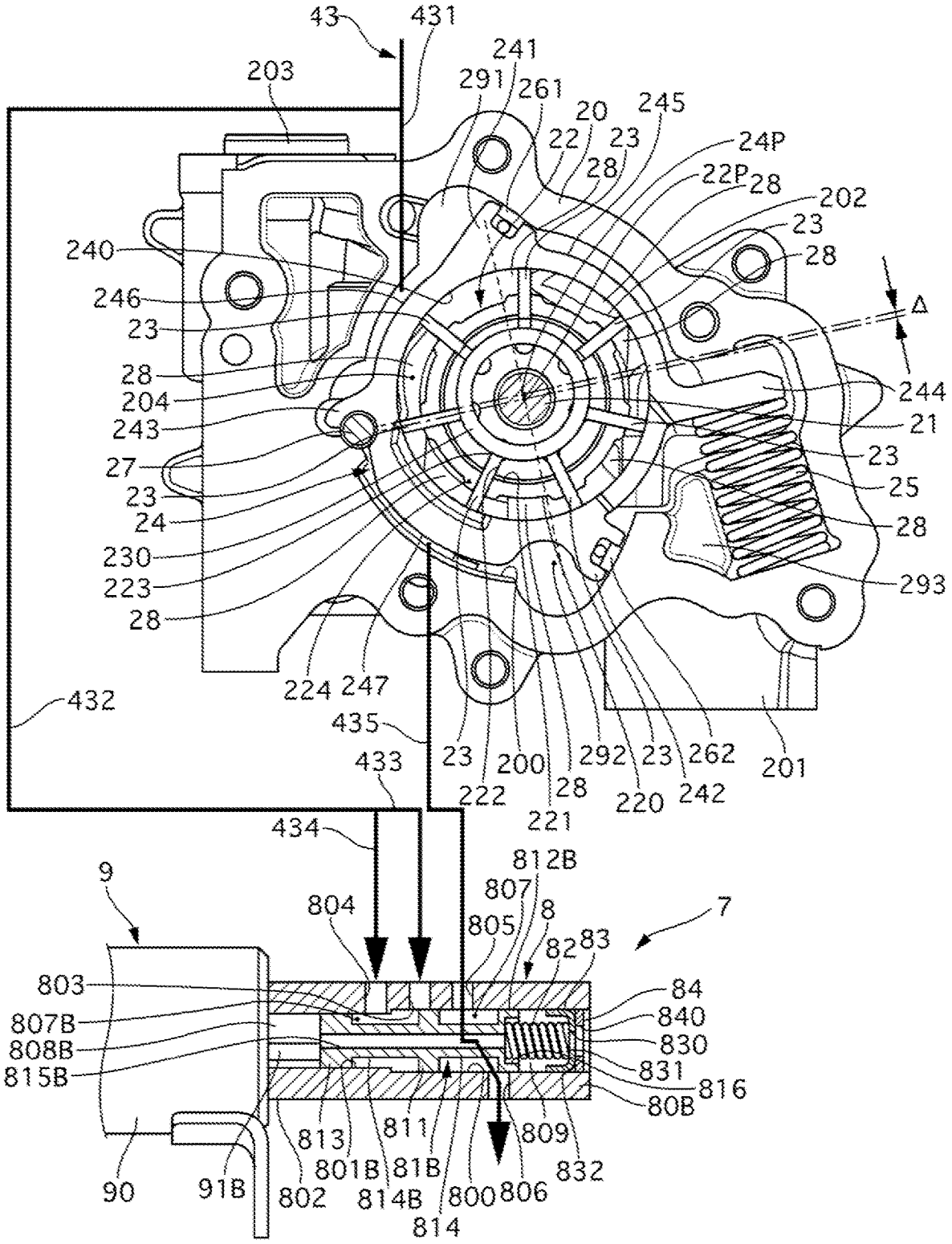
FIG. 15 is a view showing the operation state of the pump of the fourth embodiment.

Next, the manner of operation is described. The hole 815B functions as a communication hole which allows one side and the other side of the spool 81B in the axial direction to communicate with each other. Accordingly, the space 808B and the space 809 are made to communicate with each other, thus having the same pressure (atmospheric pressure). A main gallery hydraulic pressure P is introduced into the space 807B through a control passage 434 (control port 804). The diameter of the first land portion 811 (the area of a surface which receives the pressure of working oil in the space 807B) is larger than the diameter of the third land portion 813 (the area which receives the pressure of working oil in the space 807B). Accordingly, when a hydraulic pressure P is generated in the space 807B, a hydraulic pressure force fp having a magnitude obtained by multiplying the above-mentioned difference in pressure receiving area between the first land portion 811 and the third land portion 813 by the hydraulic pressure P acts on the spool 81B on one side in the axial direction. When the sum of thrust fm and hydraulic pressure force fp (fm+fp) is equal to or less than a spring force fs, as shown in FIG. 14, in the same manner as FIG. 5, the spool 81B is at an initial position so that the supply port 803 communicates with a communication port 805. The amount of eccentricity Δ becomes the maximum due to a hydraulic pressure P introduced into a second control chamber 292. When a hydraulic pressure P rises, thus causing the sum of thrust fm and hydraulic pressure force fp (fm+fp) to become larger than a spring force fs, as shown in FIG. 15, in the same manner as FIG. 6, the spool 81 moves to one side in the axial direction from the initial position so that a drainage port 806 communicates with the communication port 805. Working oil is drained from the second control chamber 292 and hence, an amount of eccentricity Δ decreases. Setting the above-mentioned difference in pressure receiving area to a small value makes a hydraulic pressure force fp small. Accordingly, in the same manner as the third embodiment, setting the set load of the spring 82 to a small value allows a solenoid portion 9 to be reduced in size, and to save power.

With the formation of the hole 815B, the space 808B has an atmospheric pressure. Accordingly, even in the case where the control valve 7 is mounted on the outer portion of an engine, it is possible to suppress that working oil leaks from the space 808B to the outside of a cylinder 80 through a connection portion between the solenoid portion 9 and the valve portion 8. The manner of other operations and advantageous effects are equal to those in the third embodiment. The end portion of the cylinder 80B (space 809) on one side in the axial direction may be closed. The configuration of this embodiment is also applicable to an embodiment other than the first embodiment.

Fifth Embodiment

Figure 16:
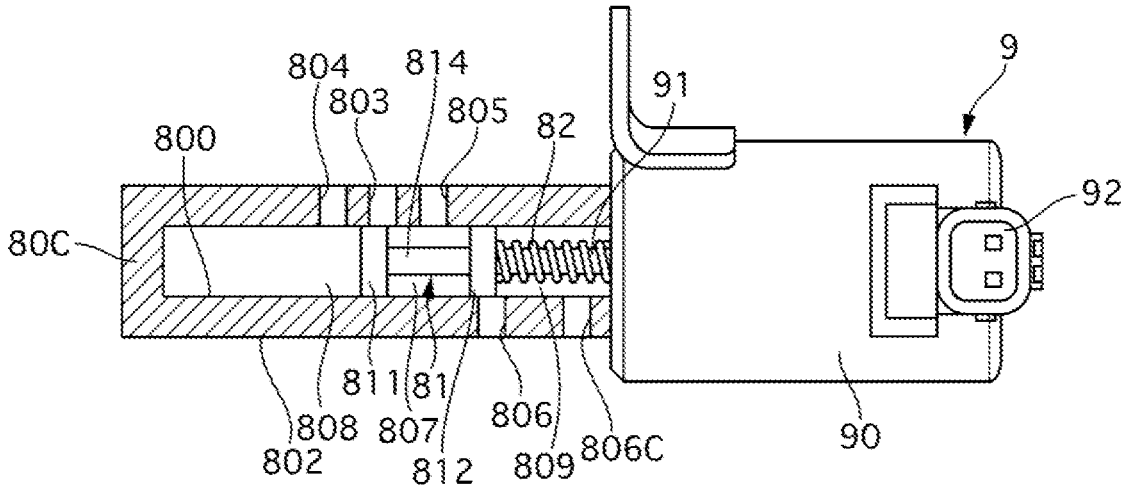
FIG. 16 is a schematic view of a control valve in a fifth embodiment.

First, the configuration is described. A control valve 7 is configured such that, as shown in FIG. 16, the other side of a cylinder 80C of a valve portion 8 in the axial direction is closed. A solenoid portion 9 is joined to one side of the valve portion 8 in the axial direction, thus closing the opening of the cylinder 80C on one side in the axial direction. The cylinder 80C has a hole 806C which penetrates the cylinder 80C in a radial direction. The hole 806C is disposed on one side of a drainage port 806 in the axial direction. A space 808 is defined, as a liquid chamber, between a first land portion 811 and the end portion of the cylinder 80C on the other side in the axial direction in the inside of the cylinder 80C. A space 809 is defined between a second land portion 812 and a casing 90 of the solenoid portion 9. The space 809 is defined between an inner peripheral surface 800 of the cylinder, the surface of the second land portion 812 on one side in the axial direction, and the surface of the casing 90 on the other side in the axial direction. The drainage port 806 is open to the space 809 in an initial state, and the hole 806C is always open to the space 809. The hole 806C allows the space 809 to be open to a low pressure portion (atmosphere) outside the cylinder 80C. One end of a spring 82 is brought into contact with the end surface of the casing 90 on the other side in the axial direction. One end of a rod 91 protrudes into the space 809, and the end surface of the rod 91 opposes the end surface of a spool 81 (second land portion 812) on one side in the axial direction. The rod 91 is disposed on the inner peripheral side of the spring 82. The rod 91 is movable corresponding to the movement of the spool 81 (the expansion and contraction of the spring 82). Due to a biasing force or the like of a return spring disposed in the casing 90, regardless of the position of the spool 81, it is possible to always maintain a state where the end surface of the rod 91 is in contact with the end surface of the spool 81 (second land portion 812) on one side in the axial direction. A solenoid can generate an electromagnetic force fm which biases the spool 81 to the other side in the axial direction (the same side as the side where the spring 82 biases the spool 81) through the rod 91. Other configurations are equal to those in the first embodiment and hence, corresponding constitutional elements are given the same reference numerals, and the repeated description of such constitutional elements is omitted.

Figure 17:
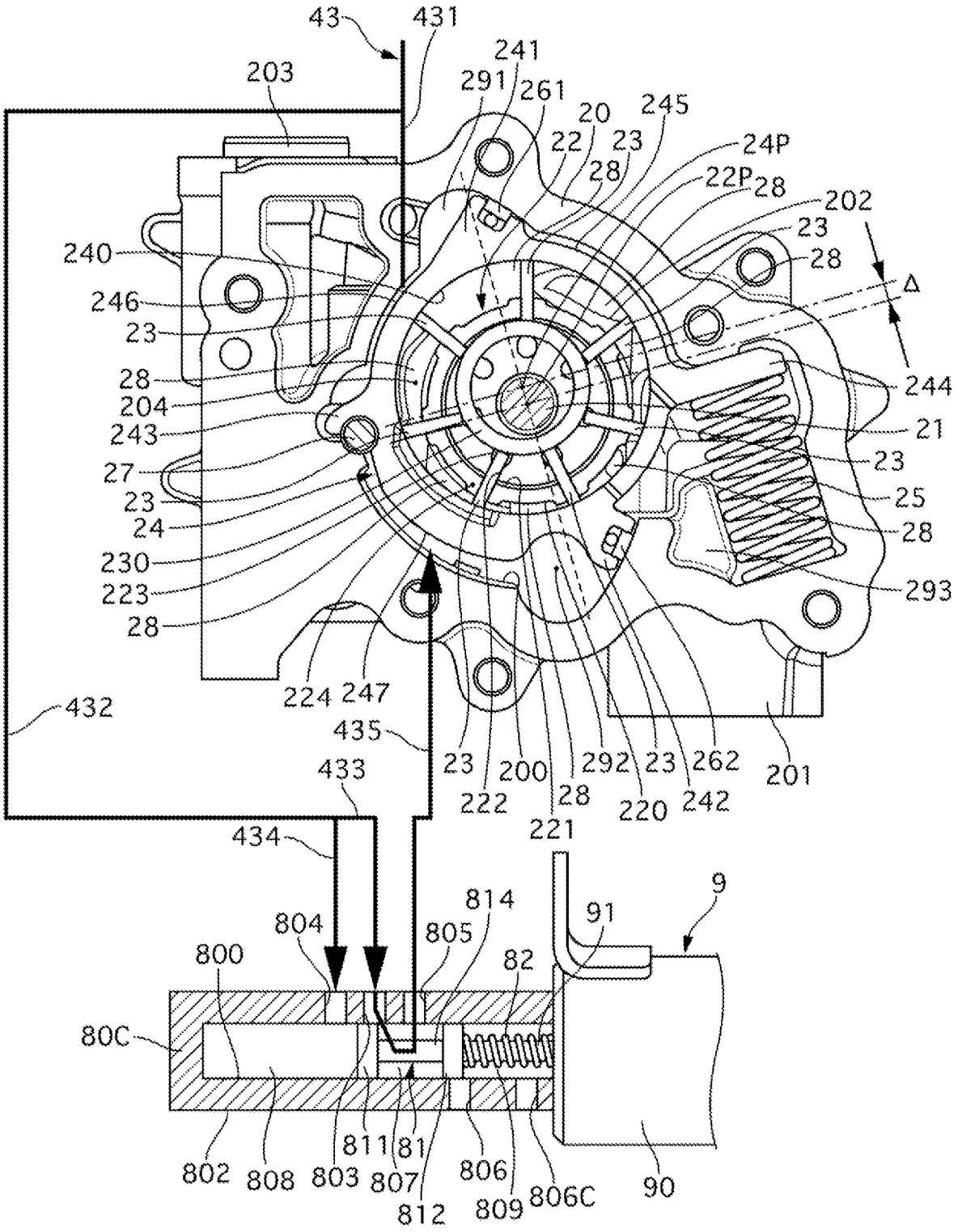
FIG. 17 is a view showing an operation state of a pump of the fifth embodiment.
Figure 18:
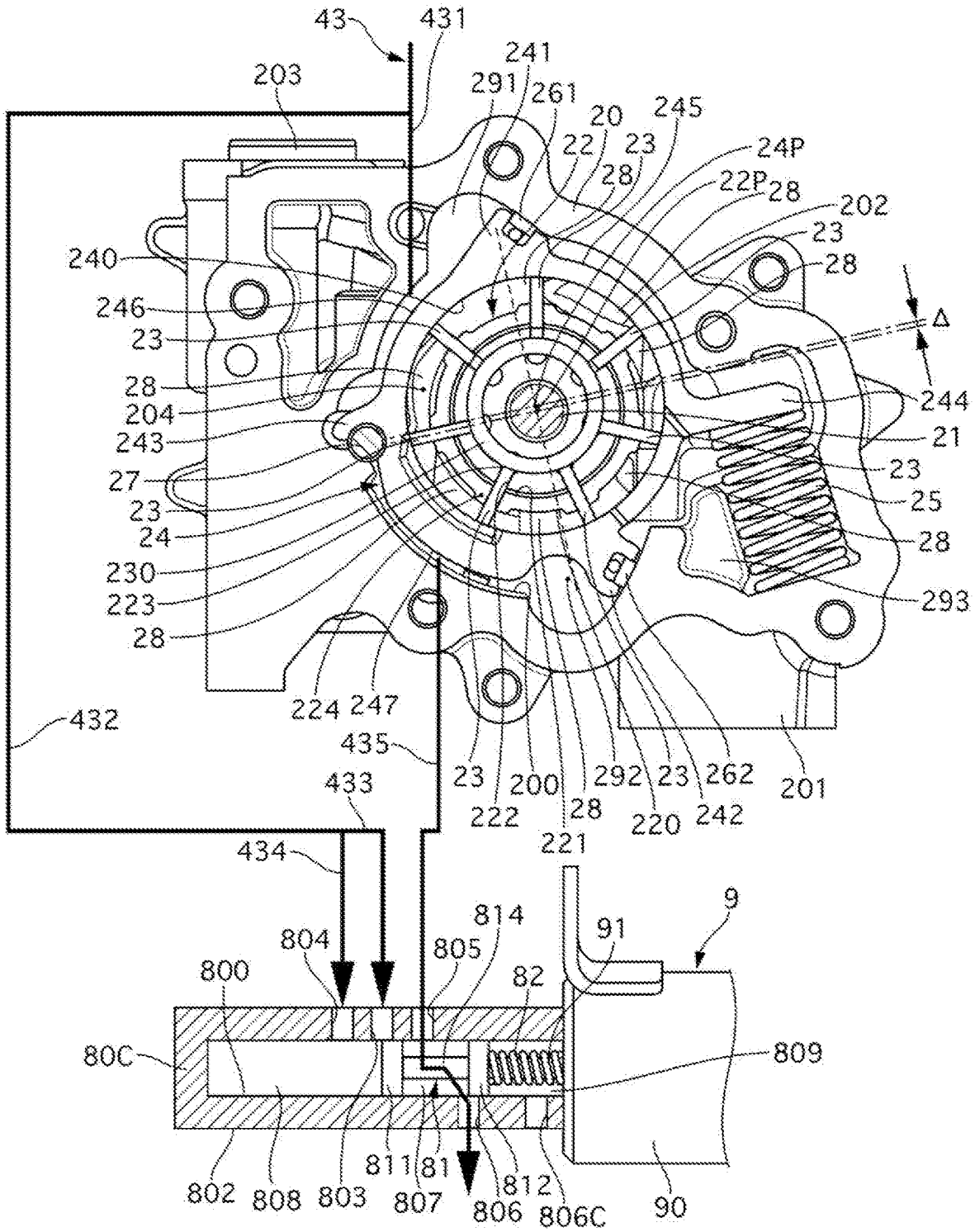
FIG. 18 is a view showing an operation state of the pump of the fifth embodiment.

Next, the manner of operation is described. With the reception of a pressure P of working oil in the space 808, the spool 81 (first land portion 811) is biased to one side in the axial direction by this hydraulic pressure P. In the same manner as a spring force fs, a thrust fm of the solenoid acts to the other side in the axial direction. In FIG. 17 and FIG. 18, a hydraulic pressure force fp acts on the spool 81 in the rightward direction, and a spring force fs and a thrust fm act on the spool 81 in the leftward direction. When a hydraulic pressure force fp is equal to or less than the sum of spring force fs and thrust fin (fs+fm), as shown in FIG. 17, in the same manner as FIG. 5, the spool 81 is at an initial position so that a supply port 803 communicates with a communication port 805. The amount of eccentricity Δ becomes the maximum due to a hydraulic pressure P introduced into a second control chamber 292. When a hydraulic pressure force fp is larger than the sum of spring force fs and thrust fm (fs+fm), as shown in FIG. 18, in the same manner as FIG. 6, the spool 81 moves to one side in the axial direction from the initial position so that the drainage port 806 communicates with the communication port 805. Working oil is drained from the second control chamber 292 and hence, an amount of eccentricity Δ decreases. Thrust fm is controlled such that the thrust fm assists spring force fs, thus allowing the spool 81 to be moved to one side in the axial direction with higher hydraulic pressure P (larger hydraulic pressure force fp). That is, a control hydraulic pressure P is increased. The larger a duty ratio D (thrust fm), the higher a control hydraulic pressure P becomes. The smaller a duty ratio D (thrust fm), a hydraulic pressure P drops more. Accordingly, it is possible to reduce a duty ratio D in controlling a discharge pressure P to a low hydraulic pressure (in reducing a control hydraulic pressure P**). Therefore, it is possible to reduce power consumption in controlling a discharge pressure P to a low hydraulic pressure (low flow rate) (during the low rotation of an engine).

The space 809 has an atmospheric pressure due to the hole 806C. Accordingly, even in the case where the control valve 7 is mounted on the outer portion of an engine, it is possible to suppress that working oil leaks from the space 809 to the outside of the cylinder 80C through a connection portion between the solenoid portion 9 and the valve portion 8. The manner of other operations and advantageous effects are equal to those in the first embodiment. The configuration of this embodiment is also applicable to an embodiment other than the first embodiment.

Sixth Embodiment

Figure 19:
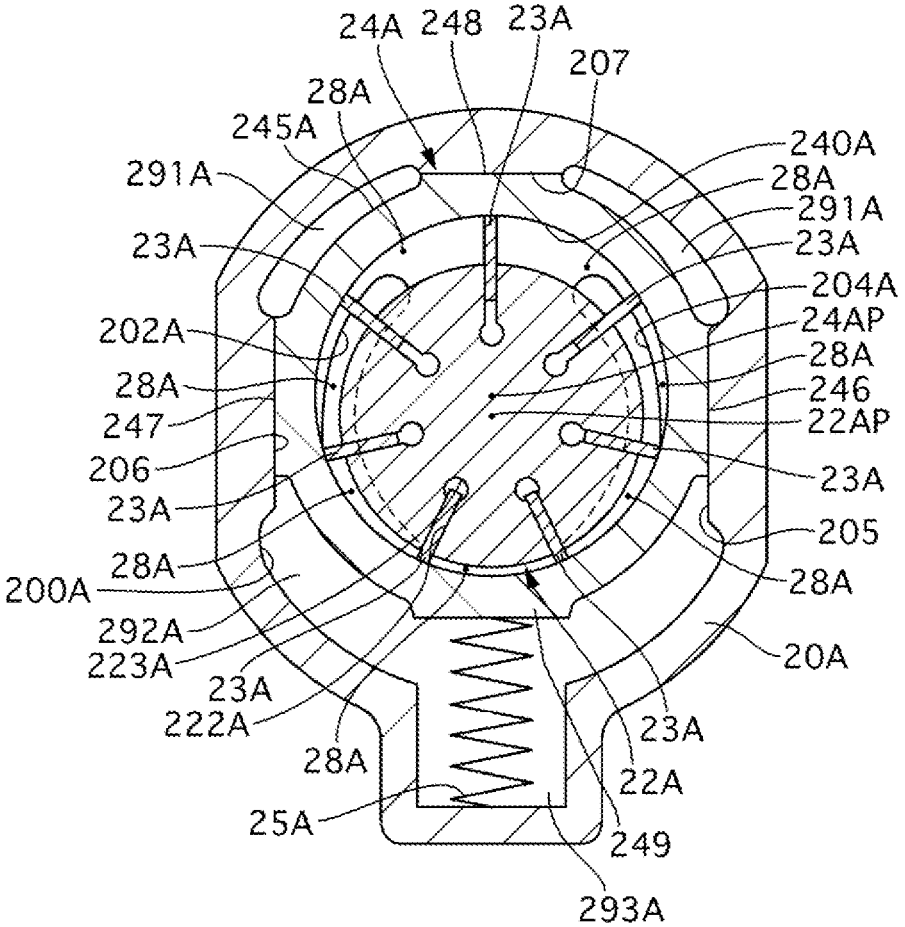
FIG. 19 is a cross-sectional view of a portion of a pump of a sixth embodiment.

First, the configuration is described. As shown in FIG. 19, a pump 2 is configured such that a cam ring 24A moves in a slidable manner. The pump 2 does not include the first sealing member 261, the second sealing member 262, and the pin 27 in the first embodiment. The inner peripheral surface of a pump accommodating chamber 200A of a housing body 20A has planar surfaces 205 to 207. These planar surfaces 205 to 207 expand parallel to an axis 22AP of a rotor 22A. The planar surfaces 205, 206 are parallel to each other, and the planar surface 207 expands in a direction orthogonal to these planar surfaces 205, 206. The outer periphery of the cam ring 24A has four protrusions 246 to 249 which protrude outward in the radial direction. The first protrusion 246 and the second protrusion 247 are disposed on sides opposite to each other with respect to an axis 24AP of an inner peripheral surface 240A of the cam ring, and the third protrusion 248 and the fourth protrusion 249 are disposed on sides opposite to each other with respect to the axis 24AP. The first protrusion 246, the second protrusion 247, and the third protrusion 248 have planar surfaces, and these planar surfaces expand parallel to the axis 24AP. The planar surface of the first protrusion 246 and the planar surface of the second protrusion 247 are parallel to each other. A distance between both planar surfaces is slightly shorter than a distance between the planar surfaces 205, 206 of the housing body 20A. The planar surface of the first protrusion 246 and the planar surface of the second protrusion 247 respectively oppose the planar surfaces 205, 206. The planar surface of the third protrusion 248 expands in a direction orthogonal to the planar surface of the first protrusion 246 (second protrusion 247), and opposes the planar surface 207 of the inner peripheral surface of the pump accommodating chamber 200A. One end of a spring 25A is mounted on the fourth protrusion 249.

A first control chamber 291A is formed of a space defined between a portion of an outer peripheral surface 245A of the cam ring ranging from the first protrusion 246 to the second protrusion 247 via the third protrusion 248 and the inner peripheral surface of the pump accommodating chamber 200A. A second control chamber 292A is formed of a space defined between a portion of the outer peripheral surface 245A of the cam ring ranging from the first protrusion 246 to the second protrusion 247 via the fourth protrusion 249 and the inner peripheral surface of the pump accommodating chamber 200A. A spring accommodating chamber 293A is integrally formed with the second control chamber 292A, and has a bottomed cylindrical shape. The other end side of the spring 25A is disposed in the spring accommodating chamber 293A. A gap formed between the planar surface of the first protrusion 246 and the planar surface 205 of the pump accommodating chamber 200A, and a gap formed between the planar surface of the second protrusion 247 and the planar surface 206 of the pump accommodating chamber 200A are small and hence, sealing is provided between the first control chamber 291A and the second control chamber 292A (spring accommodating chamber 293A). Other configurations are equal to those in the first embodiment and hence, corresponding constitutional elements are given the same reference numerals, and the repeated description of such constitutional elements is omitted.

Figure 20:
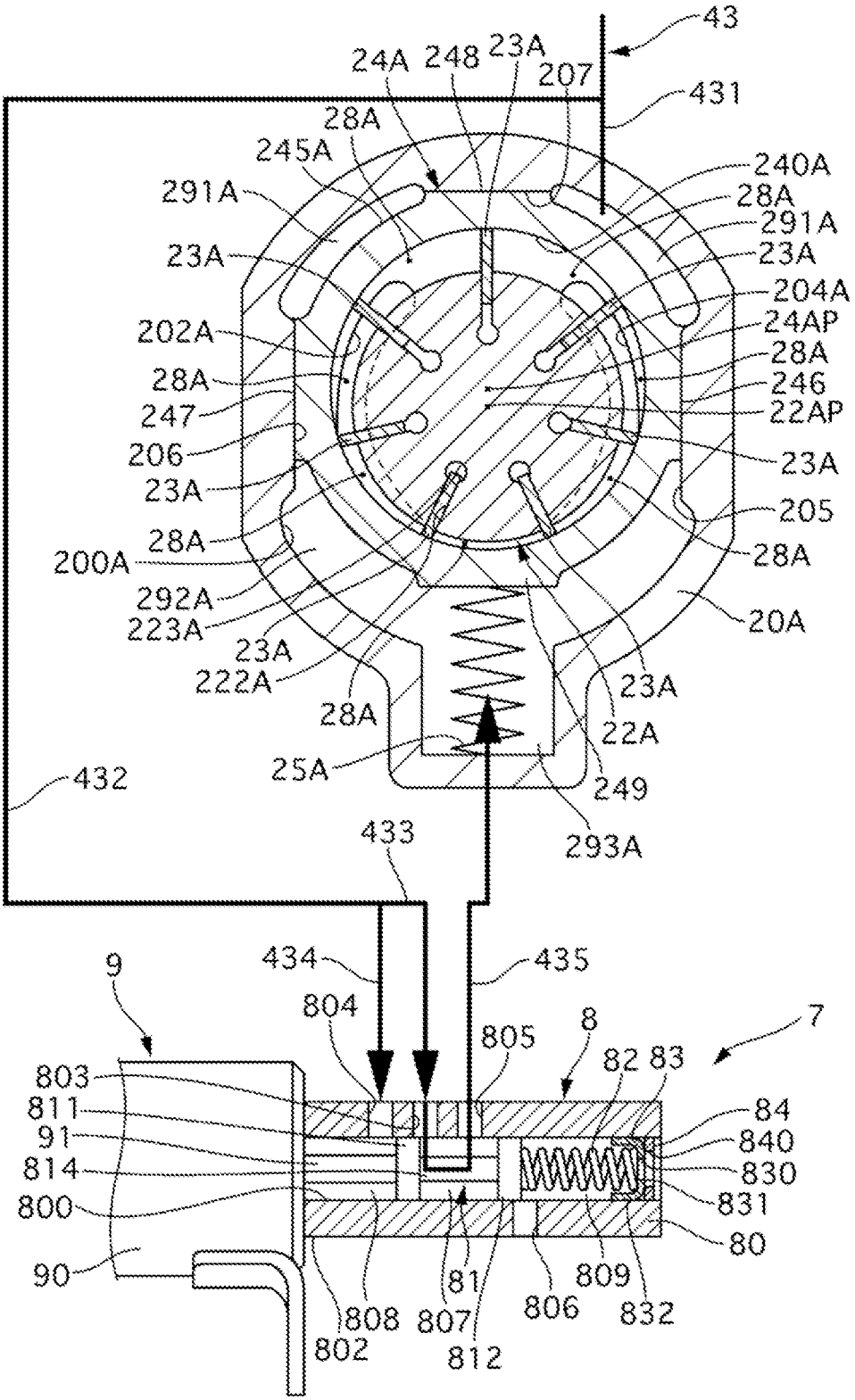
FIG. 20 is a view showing an operation state of the pump of the sixth embodiment.

Next, the manner of operation is described. The rotor 22A rotates in the clockwise direction in FIG. 19. The cam ring 24A can slidably move (linearly move in the radial direction of the rotor 22) along the planar surfaces 205, 206 in the pump accommodating chamber 200A. The planar surfaces 205, 206 are disposed in the pump accommodating chamber 200A, and function as guide portions (guides) for the above-mentioned movement. With a translational motion of the cam ring 24A, the difference (amount of eccentricity Δ) between the axis (center of rotation) 22AP of the rotor 22A and the axis (center) 24AP of the inner peripheral surface 240A of the cam ring varies. The volume of the first control chamber 291A and the volume of the second control chamber 292A are variable with the movement of the cam ring 24A. The position of the cam ring 24A (amount of eccentricity Δ) is determined by a force Fp1 caused by a pressure in the first control chamber 291A, a force Fp2 caused by a pressure in the second control chamber 292A, and a biasing force Fs of the spring 25A. When a force Fp1 becomes larger than the sum of force Fp2 and biasing force Fs (Fp2+Fs), the cam ring 24A moves to the side where an amount of eccentricity Δ (capacity) reduces. When a force Fp1 becomes smaller than the sum of force Fp2 and biasing force Fs (Fp2+Fs), the cam ring 24A moves to the side where an amount of eccentricity Δ (capacity) increases. When a hydraulic pressure force fp is equal to or less than a spring force fs, as shown in FIG. 20, in the same manner as FIG. 5, the spool 81 is at an initial position so that a supply port 803 communicates with a communication port 805. The amount of eccentricity Δ becomes the maximum due to a hydraulic pressure P introduced into the second control chamber 292A. When a hydraulic pressure force fp is larger than a spring force fs, in the same manner as FIG. 6, the spool 81 moves to one side in the axial direction from the initial position so that a drainage port 806 communicates with the communication port 805. Working oil is drained from the second control chamber 292A, thus decreasing an amount of eccentricity Δ. As described above, the configuration is adopted where the amount of eccentricity Δ (capacity) varies with a translational motion of the cam ring 24A and hence, configurations of the respective control chambers 291A, 292A can be simplified. The manner of other operations and advantageous effects are equal to those in the first embodiment. The configuration of this embodiment is also applicable to an embodiment other than the first embodiment.

Seventh Embodiment

Figure 21:
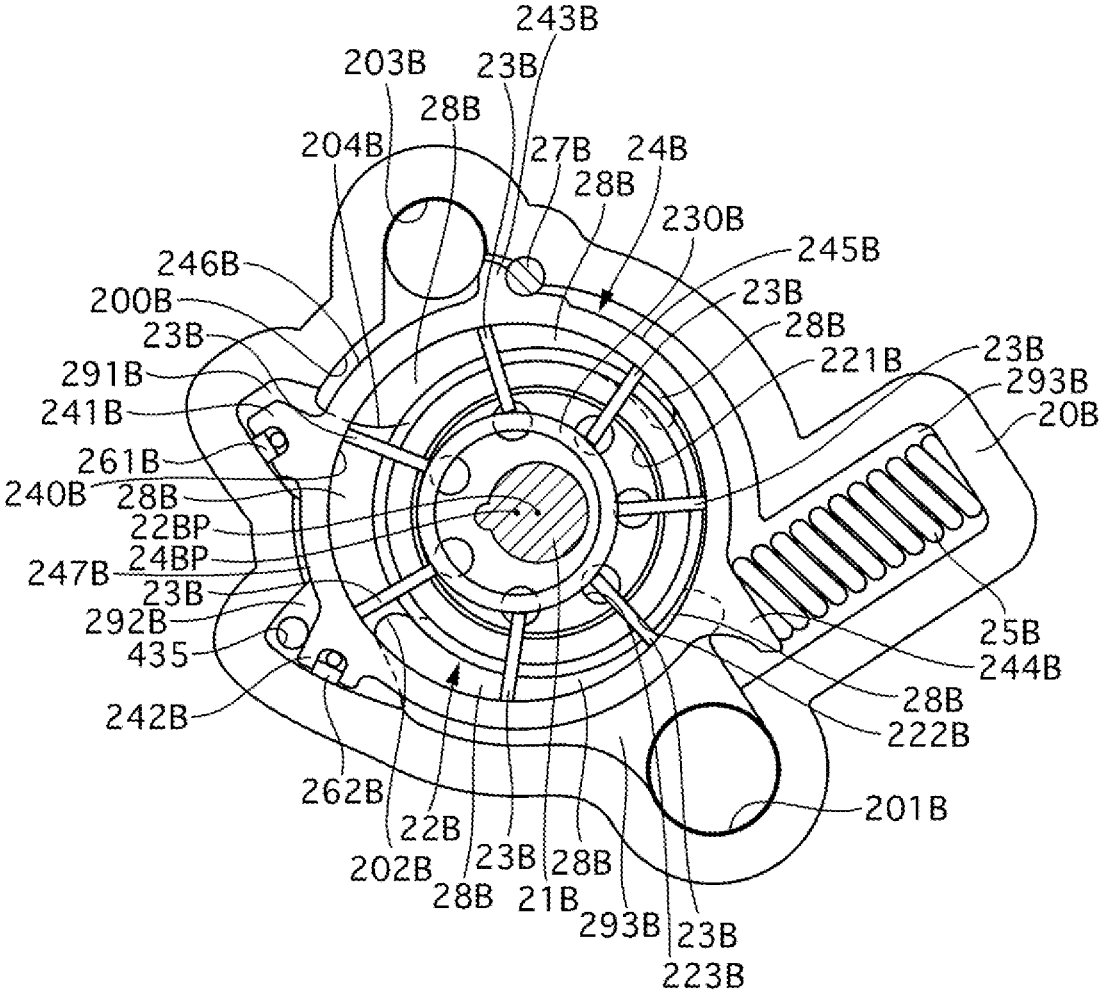
FIG. 21 is a front view of a portion of a pump of a seventh embodiment.

First, the configuration is described. A pump 2 is configured such that, as shown in FIG. 21, as viewed in the axial direction of a cam ring 24B, a first protrusion 241B and a second protrusion 242B are disposed on the same side with respect to a straight line passing through the axis of a pin 27B and a center 24BP of an inner peripheral surface 240B of the cam ring. The first protrusion 241B is disposed between the second protrusion 242B and a third protrusion 243B (pin 27B). The first protrusion 241B and the second protrusion 242B are disposed on the side opposite to a fourth protrusion 244B with respect to the above-mentioned straight line. A first control chamber 291B is formed of a space defined between a portion of an outer peripheral surface 245B of the cam ring ranging from the first protrusion 241B (first sealing member 261B) to the third protrusion 243B (pin 27B) and the inner peripheral surface of a pump accommodating chamber 200B. (A portion of) a discharge port 204B and a discharge opening 203B are open on the bottom surface of the pump accommodating chamber 200B which faces the first control chamber 291B. A second control chamber 292B is formed of a space defined between a portion of the outer peripheral surface 245B of the cam ring ranging from the first protrusion 241B (first sealing member 261B) to the second protrusion 242B (second sealing member 262B) and the inner peripheral surface of the pump accommodating chamber 200B. A second region 247B of the outer peripheral surface 245B of the cam ring between the first sealing member 261B and the second sealing member 262B faces the second control chamber 292. The second control chamber 292B is sealed by the first sealing member 261B and the second sealing member 262B. The other end of a communication passage 435 is open on the bottom surface of the pump accommodating chamber 200B which faces the second control chamber 292B. A spring accommodating chamber 293B is formed of a space defined between a portion of the outer peripheral surface 245B of the cam ring ranging from the third protrusion 243B (pin 27B) to the second protrusion 242B (second sealing member 262B) via the fourth protrusion 244B and the inner peripheral surface of the pump accommodating chamber 200B. (A portion of) an intake port 202B and an intake opening 201B are open on the bottom surface of the pump accommodating chamber 200B which faces the spring accommodating chamber 293B. The discharge port 204B communicates with both of a working chamber 28B and the first control chamber 291B, thus functioning as a first feedback passage 431.

Figure 22:
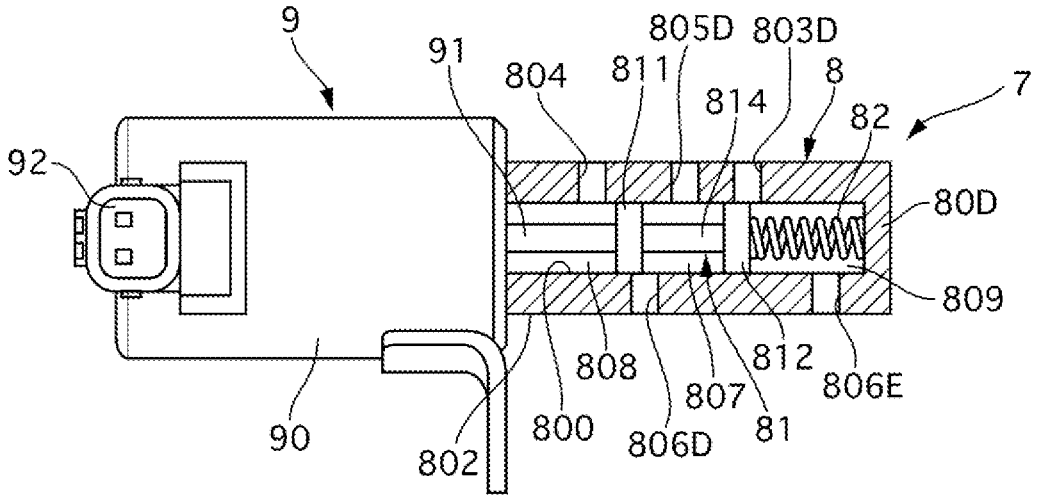
FIG. 22 is a schematic view of a control valve in the seventh embodiment.

A control valve 7 is configured such that, as shown in FIG. 22, the end portion of a cylinder 80D on one side in the axial direction is not open, but is closed. One end of a spring 82 is brought into contact with the above-mentioned end portion of the cylinder 80D. The cylinder 80D has a second drainage port 806E which penetrates the cylinder 80D in a radial direction. The second drainage port 806E, a supply port 803D, a communication port 805D, a drainage port 806D, and a control port 804 are arranged in this order from one side to the other side in the axial direction of the cylinder 80D. The drainage port 806 is open to a space 807 in an initial state. The communication port 805D is always open to the space 807, and the supply port 803D may be open to the space 807. In the inside of the cylinder 80D, a space 809 is defined between a second land portion 812 and the end portion of the cylinder 80D on one side in the axial direction. The supply port 803D is open to the space 809 in an initial state, and the second drainage port 806E is always open to the space 809. The second drainage port 806E communicates with an oil pan 400 through a drainage passage 436. Other configurations are equal to those in the first embodiment and hence, corresponding constitutional elements are given the same reference numerals, and the repeated description of such constitutional elements is omitted.

Next, the manner of operation is described. A rotor 22B rotates in the clockwise direction in FIG. 21. The cam ring 24B is biased by a spring force Fs of a spring 25 to one side in the rotational direction about the pin 27B (to the side where the amount of increase or decrease in volume of each of the plurality of working chambers 28B increases, and the amount of eccentricity Δ increases). The cam ring 24B is biased to the other side in the rotational direction about the pin 27B (to the side where the amount of increase or decrease in volume of each of the plurality of working chambers 28B decreases, and the amount of eccentricity Δ decreases) by a force Fp1 which is received by a first region 246B of the outer peripheral surface 245B, and which is caused by a hydraulic pressure P in the first control chamber 291B, and by a force Fp2 which is received by the second region 247B, and which is caused by a hydraulic pressure P in the second control chamber 292B. The volume of the first control chamber 291B and the volume of the second control chamber 292B increase with the movement of the cam ring 24B to the other side in the above-mentioned rotational direction (in the direction opposite to the direction of a spring force Fs). When the sum of force Fp1 and force Fp2 (Fp1+Fp2) becomes larger than a spring force Fs, the cam ring 24B oscillates to the other side in the above-mentioned rotational direction and hence, an amount of eccentricity Δ (capacity) reduces. When the sum of force Fp1 and force Fp2 (Fp1+Fp2) becomes smaller than a spring force Fs, the cam ring 24B oscillates to one side in the rotational direction about the pin 27B (to the side where the amount of eccentricity Δ increases) and hence, capacity increases.

Figure 23:
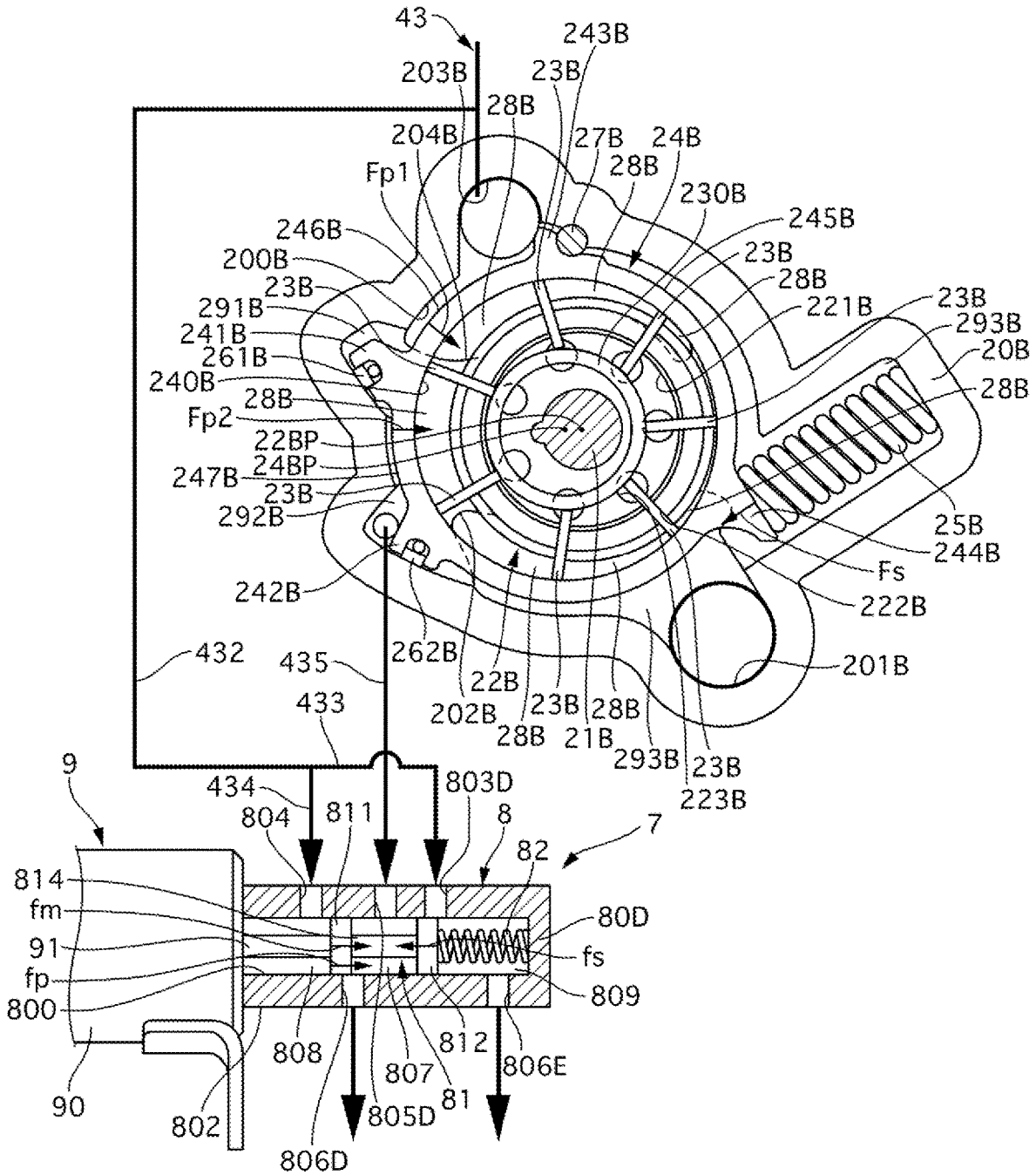
FIG. 23 is a view showing an operation state of the pump of the seventh embodiment.

A first land portion 811 of a spool 81 causes the opening area of the drainage port 806D to be varied, and a second land portion 812 of the spool 81 causes the opening area of the supply port 803D to be varied. When the spool 81 is at an initial position, in a state where the second land portion 812 closes the opening of the supply port 803D which is open to the space 807, the first land portion 811 causes the drainage port 806D to be open to the space 807. The communication passage 435 and the drainage passage 436 are connected with each other so that working oil is drained from the inside of the second control chamber 292B. Working oil is drained from the space 809 through the second drainage port 806E and hence, the space 809 is maintained at a lower pressure than the space 808. When the spool 81 moves to one side in the axial direction from the initial position, in a state where the first land portion 811 closes the opening of the drainage port 806D which is open to the space 807, the second land portion 812 causes the supply port 803D to be open to the space 807. The communication passage 435 and a supply passage 433 are connected with each other so that working oil discharged from the discharge opening 203B is introduced into the second control chamber 292B. When the sum of thrust fm and hydraulic pressure force fp (fm+fp) is equal to or less than a spring force fs (the set load of the spring 82), as shown in FIG. 23, the spool 81 is at an initial position so that the drainage port 806D communicates with the communication port 805D. Working oil is drained from the second control chamber 292B and hence, force Fp2 reduces. When the sum of force Fp1 and force Fp2 (Fp1+Fp2) is smaller than a biasing force Fs (the set load of the spring 25), the amount of eccentricity Δ becomes the maximum. When a hydraulic pressure P rises, thus causing the sum of thrust fm and hydraulic pressure force fp (fm+fp) to become larger than a spring force fs, the spool 81 moves to one side in the axial direction from the initial position so that the supply port 803D communicates with the communication port 805D. Force Fp2 is increased by a hydraulic pressure P introduced into the second control chamber 292B. When the sum of force Fp1 and force Fp2 (Fp1+Fp2) becomes larger than a biasing force Fs, an amount of eccentricity Δ decreases. The spool 81 is capable of realizing a first state where working oil discharged from the discharge opening 203B is introduced into the second control chamber 292B, and a second state where working oil is drained from the inside of the second control chamber 292B. The spool 81 realizes the first state by moving to one side in the axial direction. Accordingly, when a discharge pressure P acts on the spool 81 thus moving the spool 81 to one side in the axial direction, working oil is introduced into the second control chamber 292B and hence, capacity may decrease (discharge pressure P may drop). With such operations, a discharge pressure P can be controlled to a control hydraulic pressure P**.

As described above, the present invention is applicable to the pump 2 having the configuration where the volumes of the first control chamber 291B and the second control chamber 292B increase (a pressure in the second control chamber 292B acts in a direction that an amount of eccentricity Δ is reduced) with the movement of the cam ring 24B in the direction opposing the biasing force Fs of a spring 25B. The characteristic of main gallery hydraulic pressure P with respect to engine speed Ne can be easily caused to approximate the desired characteristic. The manner of other operations and advantageous effects are equal to those in the first embodiment. The configuration of this embodiment is also applicable to an embodiment other than the first embodiment.

Eighth Embodiment

First, the configuration is described. The basic configuration of a pump 2 is equal to that of the first embodiment (FIG. 2). However, the pump 2 has only the first control chamber 291, and does not have the second control chamber 292. To be more specific, the pump 2 does not include the second protrusion 242 and the second sealing member 262. The basic configuration of a control valve 7 is equal to that in the first embodiment (FIG. 3). However, a cylinder 80 does not have the control port 804, and has only the supply port 803, the communication port 805, and the drainage port 806. The basic configuration of a control passage 43 is equal to that in the first embodiment (FIG. 1). However, the control passage 43 includes only the first feedback passage 431 which is branched from the discharge passage 41, and does not include the second feedback passage 432. The first feedback passage 431 includes a supply passage 433, a communication passage 435, and a drainage passage 436. One end side of the supply passage 433 is branched from the discharge passage 41, and the other end of the supply passage 433 is connected to the supply port 803 of the control valve 7. One end of the communication passage 435 is connected to the communication port 805 of the control valve 7, and the other end of the communication passage 435 is connected to the first control chamber 291. One end of the drainage passage 436 is connected to the drainage port 806 of the control valve 7, and the other end of the drainage passage 436 is connected to an oil pan 400. The inside of the cylinder 80 has a first space, which is defined on one side in the axial direction by one land portion of a spool 81, and a second space, which is defined on the other side in the axial direction by the above-mentioned land portion. The supply port 803 is always open to the first space, and the communication port 805 may be open to the first space. The drainage port 806 is always open to the second space, and the communication port 805 is open to the second space in an initial state. A spring 82 biases the spool 81 to one side in the axial direction with a spring force fs. A solenoid portion 9 can bias the spool 81 to the other side in the axial direction with a thrust fin. With the reception of the pressure P of working oil introduced into the first space, the spool 81 (the above-mentioned land portion) is biased to the other side in the axial direction by a force fp caused by this hydraulic pressure P. Other configurations are equal to those in the first embodiment and hence, corresponding constitutional elements are given the same reference numerals, and the repeated description of such constitutional elements is omitted.

Next, the manner of operation is described. A cam ring 24 is biased by a spring force Fs of a spring 25 to one side in the rotational direction about a pin 27 (to the side where the amount of increase or decrease in volume of each of the plurality of working chambers 28 increases, and the amount of eccentricity Δ increases). The cam ring 24 is biased to the other side in the rotational direction about the pin 27 (to the side where the amount of increase or decrease in volume of each of the plurality of working chambers 28 decreases, and the amount of eccentricity Δ decreases) by a force Fp1 which is received by a first region 246 of an outer peripheral surface 245, and which is caused by a hydraulic pressure P in the first control chamber 291. When a force Fp1 becomes larger than a spring force Fs, the cam ring 24 oscillates to the other side in the above-mentioned rotational direction and hence, the amount of eccentricity Δ (capacity) reduces. When a force Fp1 becomes smaller than a spring force Fs, the cam ring 24 oscillates to one side in the rotational direction about the pin 27 (to the side where the amount of eccentricity Δ increases) and hence, capacity increases. The above-mentioned land portion of the spool 81 causes the opening area of the communication port 805 to be varied. When the spool 81 is at an initial position, the above-mentioned land portion closes the opening of the communication port 805 which is open to the first space, and causes the communication port 805 to be open to the second space. The communication passage 435 and the drainage passage 436 are connected with each other so that working oil is drained from the inside of the first control chamber 291. When the spool 81 moves to the other side in the axial direction from the initial position, the above-mentioned land portion causes the communication port 805 to be open to the first space, and decreases the opening area of the communication port 805 which is open to the second space. The communication passage 435 and the supply passage 433 are connected with each other so that working oil discharged through a discharge opening 203 is introduced into the first control chamber 291. When the sum of thrust fm and hydraulic pressure force fp (fm+fp) is equal to or less than spring force fs (the set load of the spring 82), the spool 81 is at an initial position so that working oil is drained from the first control chamber 291, thus reducing a force Fp1. When a force Fp1 is smaller than a spring force Fs (the set load of the spring 25), the amount of eccentricity Δ becomes the maximum. When a hydraulic pressure P rises, thus causing the sum of thrust fm and hydraulic pressure force fp (fm+fp) to become larger than a spring force fs, the spool 81 moves to the other side in the axial direction from the initial position so that a force Fp1 is increased by a hydraulic pressure P introduced into the first control chamber 291. When a force Fp1 becomes larger than a spring force Fs, an amount of eccentricity Δ decreases.

As described above, the present invention is also applicable to the pump 2 having the configuration where the control mechanism 3 (control valve 7) controls a pressure in the first control chamber 291. The characteristic of main gallery hydraulic pressure P with respect to engine speed Ne can be easily caused to approximate the desired characteristic. The manner of other operations and advantageous effects are equal to those in the first embodiment. The configuration of this embodiment is also applicable to an embodiment other than the first embodiment.

Other Embodiments

Embodiments for carrying out the present invention have been described heretofore with reference to drawings. However, the specific configuration of the present invention is not limited to any of the above-mentioned embodiments. The present invention also includes embodiments to which design change or the like is added without departing from the gist of the invention. Within a range where at least a portion of the above-mentioned problem can be solved or a range where at least a portion of the above-mentioned advantageous effects can be acquired, respective constitutional elements described in the claims and the specification may be arbitrarily combined or omitted. For example, the pump may also be used in a working oil supply system for a mechanical device other than a working oil supply system for an automobile or an engine. The specific configuration of the vane pump is not limited to the embodiments, and may be suitably changed. It is sufficient that the pump is a variable capacity pump, and members other than vanes may be used as pump structures. A member other than a cam ring may be used as a movable member which causes the amount of increase or decrease in volume of each of the plurality of working chambers during the rotation of pump structures to be varied. For example, a pump may be formed of a trochoid gear pump. In this case, by disposing an outer rotor, which is an external gear, so as to allow eccentric movement, and by disposing a control chamber and a spring on the outer peripheral side of the outer rotor, it is possible to realize a variable capacity pump (the outer rotor corresponds to the movable member).

Each of the arithmetic operation portion and the reception portion of the ECU is realized by software in a microcomputer in the embodiments. However, the arithmetic operation portion or the reception portion of the ECU may be realized by an electronic circuit. An arithmetic operation means not only an arithmetic operation using a formula, but also general processing performed on software. The reception portion may be an interface of a microcomputer, or may be software in the microcomputer. A control signal may be a signal relating to a current value, or a signal relating to the thrust of a rod. A method for controlling an electric current to be supplied to a solenoid is not limited to PWM control. Current values which correspond to rotational speeds of an engine may be set in advance by a map. Characteristic information which causes a control signal of a solenoid to be varied according to variation in engine speed may be realized by performing an arithmetic operation instead of being realized by a map in a microcomputer.

Other Aspects which May be Understood Based on Embodiments

Other aspects which may be understood based on the above-mentioned embodiment are described hereinafter.

(1) In one aspect, a variable capacity pump includes:

a housing including a pump accommodating chamber therein;

a pump structure disposed in the pump accommodating chamber, and configured to vary volumes of a plurality of working chambers with rotation, the pump structure being configured to discharge from a discharge portion working oil introduced from an intake portion by being rotationally driven;

a movable member disposed in the pump accommodating chamber, and accommodating the pump structure to define the plurality of working chambers, the movable member being configured to cause an amount of increase or decrease in volume of each of the plurality of working chambers during rotation of the pump structure to be varied by moving so that an amount of eccentricity of a center of an inner periphery of the movable member from a center of rotation of the pump structure varies;

a first biasing member disposed in the pump accommodating chamber, and configured to bias the movable member in a direction that the amount of increase or decrease in volume of each of the plurality of working chambers increases;

a first control chamber which is disposed between the pump accommodating chamber and the movable member, and into which the working oil discharged from the discharge portion is introduced, a volume of the first control chamber increasing with movement of the movable member in a direction opposing a biasing force of the first biasing member;

a second control chamber which is disposed between the pump accommodating chamber and the movable member, and into which the working oil discharged from the discharge portion is introduced through a passage, a volume of the second control chamber being variable with movement of the movable member; and a control mechanism including a spool provided in the passage, and configured to control introduction of working oil into the second control chamber by moving in a cylindrical portion, the spool being biased to one side in an axial direction by a pressure of the working oil introduced into the cylindrical portion from the discharge portion, a second biasing member which biases the spool to an opposite side in the axial direction, and a solenoid configured to generate an electromagnetic force for biasing the spool in the axial direction, and to change a magnitude of the electromagnetic force according to a value of an electric current supplied.

(2) In a more preferred aspect, in the above-mentioned aspect, the spool is configured to realize a first state where working oil discharged from the discharge portion is introduced into the second control chamber, and a second state where working oil is drained from an inside of the second control chamber, the spool being further configured to realize the second state by moving to the one side in the axial direction.

(3) In another preferred aspect, in any one of the above-mentioned aspects, the solenoid, by changing the magnitude of the electromagnetic force, varies a pressure, of working oil discharged from the discharge portion, at which movement of the spool is started.

(4) In still another preferred aspect, in any one of the above-mentioned aspects, the control mechanism decreases an amount of working oil drained from the inside of the second control chamber with an increase in amount of working oil discharged from the discharge portion and introduced into the second control chamber, and the control mechanism increases the amount of working oil drained from the inside of the second control chamber with a decrease in amount of working oil discharged from the discharge portion and introduced into the second control chamber.

(5) In still another preferred aspect, in any one of the above-mentioned aspects, the cylindrical portion has a supply opening which allows working oil discharged from the discharge portion to be introduced into the cylindrical portion, a communication opening which allows an inside of the cylindrical portion and the second control chamber to communicate with each other, and a drainage opening which allows working oil to be drained from the inside of the cylindrical portion, and the spool includes a first land portion which causes an opening area of the supply opening to be varied, and a second land portion which causes an opening area of the drainage opening to be varied.

(6) In still another preferred aspect, in any one of the above-mentioned aspects, a diameter of the first land portion is larger than a diameter of the second land portion.

(7) In still another preferred aspect, in any one of the above-mentioned aspects, the cylindrical portion has a second supply opening which allows working oil discharged from the discharge portion to be introduced into the cylindrical portion, and the spool includes a third land portion, a liquid chamber is defined between the third land portion and the first land portion in the cylindrical portion, the second supply opening is open to the liquid chamber, and a diameter of the third land portion is smaller than a diameter of the first land portion.

(8) In still another preferred aspect, in any one of the above-mentioned aspects, a member which allows the solenoid to bias the spool in the axial direction is provided separate from the spool.

(9) In still another preferred aspect, in any one of the above-mentioned aspects, the cylindrical portion has a first supply opening and a second supply opening which communicate with the discharge portion, a communication opening which communicates with the second control chamber, and a drainage opening which communicates with a low pressure portion, and the spool moves in the cylindrical portion upon reception of a pressure of working oil introduced into the cylindrical portion from the discharge portion through the second supply opening, thus switching between establishing and shutting off of communication between the discharge portion and the second control chamber through the first supply opening and the communication opening, and switching between establishing and shutting off of communication between the second control chamber and the low pressure portion through the communication opening and the drainage opening.

(10) In still another preferred aspect, in any one of the above-mentioned aspects, the solenoid is configured to generate an electromagnetic force which biases the spool to the opposite side in the axial direction.

(11) In still another preferred aspect, in any one of the above-mentioned aspects, the spool has a hole which penetrates the spool in the axial direction.

(12) In still another preferred aspect, in any one of the above-mentioned aspects, the cylindrical portion has a hole which allows a space formed between one end of the spool in the axial direction and an inner periphery of the cylindrical portion to be open to an atmosphere outside the cylindrical portion.

(13) In still another preferred aspect, in any one of the above-mentioned aspects, a volume of the second control chamber increases with movement of the movable member in the same direction as a direction of a biasing force of the first biasing member.

(14) In still another preferred aspect, in any one of the above-mentioned aspects, the movable member includes a first pressure receiving surface facing the first control chamber, and a second pressure receiving surface facing the second control chamber, and having a pressure receiving area larger than a pressure receiving area of the first pressure receiving surface.

(15) In still another preferred aspect, in any one of the above-mentioned aspects, the movable member is configured to oscillate about a fulcrum in the pump accommodating chamber.

(16) In still another preferred aspect, in any one of the above-mentioned aspects, the movable member is configured to perform a translational motion in the pump accommodating chamber.

(17) In still another preferred aspect, in any one of the above-mentioned aspects, the movable member is configured to oscillate about a fulcrum in the pump accommodating chamber, and a volume of the second control chamber increases with movement of the movable member in a direction opposing the biasing force of the first biasing member.

(18) Further, from another view point, in one of the other aspects, a variable capacity pump includes:

a housing including a pump accommodating chamber therein;

a pump structure disposed in the pump accommodating chamber, and configured to vary volumes of a plurality of working chambers with rotation, the pump structure being configured to discharge from a discharge portion working oil introduced from an intake portion by being rotationally driven;

a movable member disposed in the pump accommodating chamber, and accommodating the pump structure to define the plurality of working chambers, the movable member being configured to cause an amount of increase or decrease in volume of each of the plurality of working chambers during rotation of the pump structure to be varied by moving so that an amount of eccentricity of a center of an inner periphery of the movable member from a center of rotation of the pump structure varies;

a first biasing member disposed in the pump accommodating chamber, and configured to bias the movable member in a direction that the amount of increase or decrease in volume of each of the plurality of working chambers increases;

a first control chamber which is disposed between the pump accommodating chamber and the movable member, and into which the working oil discharged from the discharge portion is introduced, a volume of the first control chamber increasing with movement of the movable member in a direction opposing a biasing force of the first biasing member; and a control valve configured to control a pressure in the first control chamber, the control valve including

- a spool which is movable in a cylindrical portion, and which is biased to one side in the axial direction by working oil introduced into the cylindrical portion from the discharge portion,
- a second biasing member which biases the spool to an opposite side in the axial direction, and
- a solenoid configured to continuously change an electromagnetic force for biasing the spool in the axial direction.

(19) In one aspect, a working oil supply system for an internal combustion engine includes:

a housing including a pump accommodating chamber therein;

a pump structure disposed in the pump accommodating chamber, and configured to vary volumes of a plurality of working chambers with rotation, the pump structure being configured to discharge working oil introduced from an intake portion by being rotationally driven, from a discharge portion so as to supply the working oil to the internal combustion engine;

a movable member disposed in the pump accommodating chamber, and accommodating the pump structure to define the plurality of working chambers, the movable member being configured to cause an amount of increase or decrease in volume of each of the plurality of working chambers during rotation of the pump structure to be varied by moving so that an amount of eccentricity of a center of an inner periphery of the movable member from a center of rotation of the pump structure varies;

a first biasing member disposed in the pump accommodating chamber, and configured to bias the movable member in a direction that the amount of increase or decrease in volume of each of the plurality of working chambers increases;

a first control chamber which is disposed between the pump accommodating chamber and the movable member, and into which the working oil discharged from the discharge portion is introduced, a volume of the first control chamber increasing with movement of the movable member in a direction opposing a biasing force of the first biasing member;

a second control chamber which is disposed between the pump accommodating chamber and the movable member, and into which the working oil discharged from the discharge portion is introduced through a passage, a volume of the second control chamber being variable with movement of the movable member;

a control mechanism including a spool provided in the passage, and configured to control introduction of working oil into the second control chamber by moving in a cylindrical portion, the spool being biased to one side in an axial direction by the working oil introduced into the cylindrical portion from the discharge portion, a second biasing member which biases the spool to an opposite side in the axial direction, and a solenoid configured to generate an electromagnetic force for biasing the spool in the axial direction, and to change a magnitude of the electromagnetic force according to a value of an electric current supplied; and a control portion configured to cause a value of an electric current which is supplied to the solenoid to be varied such that, within a predetermined range of rotational speed of the internal combustion engine, a difference between a pressure of working oil discharged from the discharge portion and a predetermined required value falls within a predetermined range.

(20) In a more preferred aspect, in the above-mentioned aspect, the control portion does not supply an electric current to the solenoid in a state where a rotational speed of the internal combustion engine is less than a predetermined value.

(21) In another preferred aspect, in any one of the above-mentioned aspects, the working oil supply system for the internal combustion engine includes;

a pressure measuring portion configured to measure a pressure of working oil discharged from the discharge portion; and a rotational speed measuring portion configured to measure a rotational speed of the internal combustion engine, wherein in a state where the rotational speed measured by the rotational speed measuring portion is larger than a predetermined value, the control portion calculates a difference between the pressure measured by the pressure measuring portion and the required value at an arbitrary rotational speed measured by the rotational speed measuring portion, in a case where the difference is larger than a predetermined value, a value of an electric current supplied to the solenoid is varied so as to reduce the difference, and in a case where the difference is equal to or less than the predetermined value, a value of the electric current supplied to the solenoid is maintained.

This application claims priority to Japanese patent application No. 2016-181740 filed on Sep. 16, 2016. The entire disclosure including the specification, the claims, the drawings, and the abstract of Japanese patent application No. 2016-181740 filed on Sep. 16, 2016 is incorporated herein by reference.

REFERENCE SIGNS LIST

1 working oil supply system
2 variable capacity pump
20 housing body
200 pump accommodating chamber
201 intake opening (intake portion)
203 discharge opening (discharge portion)
22 rotor (pump structure)
23 vane (pump structure)
24 cam ring (movable member)
25 spring (first biasing member)
28 working chamber
291 first control chamber
292 second control chamber
3 control mechanism
4 passage
6 engine control unit (control portion)
7 control valve
8 valve portion
80 cylinder (cylindrical portion)
81 spool
82 spring (second biasing member)
9 solenoid portion

The invention claimed is:

1. A variable capacity pump comprising:

a housing including a pump accommodating chamber therein;

a pump disposed in the pump accommodating chamber, and configured to vary volumes of a plurality of working chambers with rotation, the pump being configured to discharge from a discharge portion working oil introduced from an intake portion by being rotationally driven;

a mover disposed in the pump accommodating chamber, and accommodating the pump to define the plurality of working chambers, the mover being configured to cause an amount of increase or decrease in volume of each respective working chamber of the plurality of working chambers during rotation of the pump to be varied by moving so that an amount of eccentricity of a center of an inner periphery of the mover from a center of rotation of the pump structure varies;

a first biasing member disposed in the pump accommodating chamber, and configured to bias the mover in a direction that the amount of increase or decrease in volume of each of the plurality of working chambers increases;

a first control chamber which is disposed between the pump accommodating chamber and the mover, and into which the working oil discharged from the discharge portion is introduced, a volume of the first control chamber increasing with movement of the mover in a direction opposing a biasing force of the first biasing member;

a second control chamber which is disposed between the pump accommodating chamber and the mover, and into which the working oil discharged from the discharge portion is introduced through a passage, a volume of the second control chamber being variable with movement of the mover; and a control mechanism provided in the passage including a cylindrical portion including a first inner peripheral surface of a first diameter and a second inner peripheral surface of a second diameter smaller than the first diameter;

a first diameter portion configured to slide on the first inner peripheral surface having the first diameter;

a second diameter portion configured to slide on the second inner peripheral surface having the second diameter;

a spool configured to connect the first diameter portion and the second diameter portion and having a first shaft portion formed with a third diameter smaller than the first diameter and the second diameter;

a space formed by the shaft portion, the first inner peripheral surface having the first diameter, and the second inner peripheral surface having the second diameter;

a solenoid configured to generate an electromagnetic force for biasing the spool to one side in an axial direction, and to change a magnitude of the electromagnetic force according to a value of an electric current supplied; and a second biasing member which biases the spool to an opposite side in the axial direction, wherein the control mechanism is configured to switch between a first state, in which the passage and the second control chamber are connected, and a second state, in which the second control chamber is connected to a first pressure portion, by moving the spool in the axial direction in the cylindrical portion by using hydraulic pressure force for biasing the spool to the one side in the axial direction due to a difference in area between surfaces of the first diameter portion and the second diameter portion facing each other when the working oil from the passage is introduced into the space formed by the shaft portion and the first inner peripheral surface having the first diameter and the second inner peripheral surface having the second diameter, the electromagnetic force of the solenoid for biasing the spool to the one side in the axial direction, and the biasing force of the second biasing member for biasing the spool to the opposite side in the axial direction.

2. The variable capacity pump according to claim 1, wherein the solenoid, by changing the magnitude of the electromagnetic force, varies a pressure of working oil discharged from the discharge portion, at which movement of the spool is started.

3. The variable capacity pump according to claim 1, wherein the control mechanism decreases an amount of working oil drained from an inside of the second control chamber with an increase in amount of working oil discharged from the discharge portion and introduced into the second control chamber, and the control mechanism increases the amount of working oil drained from the inside of the second control chamber with a decrease in amount of working oil discharged from the discharge portion and introduced into the second control chamber.

4. The variable capacity pump according to claim 3, wherein the cylindrical portion has a supply opening which allows working oil discharged from the discharge portion to be introduced into the cylindrical portion, a communication opening which allows an inside of the cylindrical portion and the second control chamber to communicate with each other, and a drainage opening which allows working oil to be drained from the inside of the cylindrical portion, and the spool includes the first diameter portion which causes an opening area of the supply opening to be varied, and the second diameter portion which causes an opening area of the drainage opening to be varied.

5. The variable capacity pump according to claim 3, wherein a rod which allows the solenoid to bias the spool in the axial direction is provided separate from the spool.

6. The variable capacity pump according to claim 1, wherein the spool has a hole which penetrates the spool in the axial direction.

7. The variable capacity pump according to claim 1, wherein the cylindrical portion has a hole which allows a space formed between one end of the spool in the axial direction and an inner periphery of the cylindrical portion to be open to an atmosphere outside the cylindrical portion.

8. The variable capacity pump according to claim 1, wherein a volume of the second control chamber increases with movement of the mover in the same direction as a direction of a biasing force of the first biasing member.

9. The variable capacity pump according to claim 8, wherein the mover includes a first pressure receiving surface facing the first control chamber, and a second pressure receiving surface facing the second control chamber, and having a pressure receiving area larger than a pressure receiving area of the first pressure receiving surface.

10. The variable capacity pump according to claim 8, wherein the mover is configured to oscillate about a fulcrum in the pump accommodating chamber.

11. The variable capacity pump according to claim 8, wherein the mover is configured to perform a translational motion in the pump accommodating chamber.

* * * * *